US012747529B2

(12) United States Patent
Kim et al.

(10) Patent No.: US 12,747,529 B2
(45) Date of Patent: Sep. 29, 2026

(54) CLOTHES CARE APPARATUS AND METHOD FOR CONTROLLING THE SAME

(71) Applicant: SAMSUNG ELECTRONICS CO., LTD., Suwon-si (KR)

(72) Inventors: Zoohyeong Kim, Suwon-si (KR); Daegeon Kim, Suwon-si (KR); Jongwon Park, Suwon-si (KR); Jonghun Sung, Suwon-si (KR); Jaewan Hong, Suwon-si (KR)

(73) Assignee: SAMSUNG ELECTRONICS CO., LTD.

( * ) Notice: Subject to any disclaimer, the term of this patent is extended or adjusted under 35 U.S.C. 154(b) by 90 days.

(21) Appl. No.: 18/773,849

(22) Filed: Jul. 16, 2024

(65) Prior Publication Data

US 2025/0075387 A1 Mar. 6, 2025

Related U.S. Application Data

(63) Continuation of application No. PCT/KR2024/008839, filed on Jun. 26, 2024.

(30) Foreign Application Priority Data

Aug. 31, 2023 (KR) ..... 10-2023-0115792
Jan. 3, 2024 (KR) ..... 10-2024-0001047

(51) Int. Cl.
*D06F 25/00* (2006.01)
*D06F 33/54* (2020.01)
(Continued)

(52) U.S. Cl.
CPC ..... *D06F 25/00* (2013.01); *D06F 33/54* (2020.02); *D06F 33/56* (2020.02); *D06F 33/57* (2020.02);
(Continued)

(58) Field of Classification Search
None
See application file for complete search history.

(56) References Cited

U.S. PATENT DOCUMENTS 9,909,249 B2 3/2018 Kim et al.
11,162,207 B2 11/2021 Bueno et al.
(Continued)

FOREIGN PATENT DOCUMENTS

CN 106245280 A 12/2016
JP 2010-94226 4/2010
(Continued)

OTHER PUBLICATIONS

International Search Report dated Oct. 22, 2024 for International Application No. PCT/KR2024/008839.
(Continued)

*Primary Examiner* — Levon J Shahinian
(74) *Attorney, Agent, or Firm* — STAAS & HALSEY LLP

(57) ABSTRACT

A clothes care apparatus may include a tub; an upper detergent supply device disposed above the tub; a lower detergent supply device disposed below the tub; a heat exchanger disposed above the tub; a nozzle device configured to spray water to the heat exchanger; a first pipe configured to supply water to the upper detergent supply device; a second pipe configured to supply water to the nozzle device; a third pipe configured to supply water to the tub; a water supply device configured to be connected to the first pipe, the second pipe, and the third pipe; and a controller configured to control the water supply device to supply water to at least one of the upper detergent supply device, the nozzle device or the tub, so as to perform at least one of a washing process, a rinsing process, a spin-drying process or a drying process.

15 Claims, 16 Drawing Sheets

(51) Int. Cl.

| | |
|---|---|
| ***D06F 33/56*** | (2020.01) |
| ***D06F 33/57*** | (2020.01) |
| ***D06F 33/58*** | (2020.01) |
| ***D06F 33/60*** | (2020.01) |
| ***D06F 33/68*** | (2020.01) |
| ***D06F 33/69*** | (2020.01) |
| ***D06F 37/04*** | (2006.01) |
| ***D06F 37/28*** | (2006.01) |
| ***D06F 39/02*** | (2006.01) |
| ***D06F 39/08*** | (2006.01) |
| ***D06F 58/20*** | (2006.01) |
| ***D06F 58/24*** | (2006.01) |
| ***D06F 58/45*** | (2020.01) |
| ***F28G 1/16*** | (2006.01) |
| ***F28G 15/00*** | (2006.01) |
| *D06F 105/02* | (2020.01) |
| *D06F 105/36* | (2020.01) |
| *D06F 105/42* | (2020.01) |
| *D06F 105/54* | (2020.01) |

(52) U.S. Cl.

CPC ..... *D06F 33/58* (2020.02); *D06F 33/60* (2020.02); *D06F 33/68* (2020.02); *D06F 33/69* (2020.02); *D06F 37/04* (2013.01); *D06F 37/28* (2013.01); *D06F 39/02* (2013.01); *D06F 39/088* (2013.01); *D06F 58/203* (2013.01); *D06F 58/206* (2013.01); *D06F 58/24* (2013.01); *D06F 58/45* (2020.02); *F28G 1/166* (2013.01); *F28G 15/003* (2013.01); *D06F 2105/02* (2020.02); *D06F 2105/36* (2020.02); *D06F 2105/42* (2020.02); *D06F 2105/54* (2020.02)

(56) References Cited

U.S. PATENT DOCUMENTS

| | | | | |
|---|---|---|---|---|
| 2016/0083896 | A1* | 3/2016 | Ryoo ..... | D06F 58/206 34/86 |
| 2022/0081824 | A1 | 3/2022 | Huang et al. | |

FOREIGN PATENT DOCUMENTS

| | | |
|---|---|---|
| JP | 6890403 | 6/2021 |
| KR | 10-2005-0066356 | 6/2005 |
| KR | 10-2005-0118622 | 12/2005 |
| KR | 10-2014-0039249 | 4/2014 |
| KR | 10-2016-0049733 | 5/2016 |
| KR | 10-2019-0024573 | 3/2019 |
| KR | 10-2021-0087649 A | 7/2021 |
| WO | WO 2014/016996 A1 | 1/2014 |

OTHER PUBLICATIONS

Written Opinion of the International Searching Authority dated Oct. 22, 2024 for International Application No. PCT/KR2024/008839.

* cited by examiner

FIG. 16

1600

| | WASHING PROCESS | RINSING PROCESS | SPIN-DRYING PROCESS | DRYING PROCESS | |
|---|---|---|---|---|---|
| FIRST WATER SUPPLY FLOW PATH (UPPER DETERGENT SUPPLY DEVICE | CLOSE | OPEN | CLOSE | OPEN FOR PREDETERMINED PERIOD OF TIME FOR PREVENTING MOISTURE LEAKAGE | CLOSE |
| SECOND WATER SUPPLY FLOW PATH (NOZZLE DEVICE) | CLOSE | CLOSE | CLOSE | CLOSE | OPEN FOR PREDETERMINED PERIOD OF TIME FOR CLEANING HEAT EXCHANGER |
| THIRD WATER SUPPLY FLOW PATH (TUB) | OPEN | OPEN | OPEN FOR PREDETERMINED PERIOD OF TIME FOR CLEANING DOOR | CLOSE | CLOSE |

CLOTHES CARE APPARATUS AND METHOD FOR CONTROLLING THE SAME

CROSS-REFERENCE TO RELATED APPLICATIONS

This is a continuation application, under 35 U.S.C. § 111 (a), of International Application PCT/KR2024/008839, filed Jun. 26, 2024, which claims priority under 35 U.S.C. § 119 to Korean Patent Application No. 10-2023-0115792, filed Aug. 31, 2023 and Korean Patent Application No. 10-2024-0001047, filed Jan. 3, 2024, in the Korean Intellectual Property Office, the disclosures of which are incorporated herein in their entireties by reference.

TECHNICAL FIELD

The disclosure relates to a clothes care apparatus including a drying device and a method for controlling the same.

BACKGROUND ART

A clothes care apparatus is an apparatus for treating and/or caring for clothes. The clothes care apparatus includes a washing machine and a dryer. The washing machine may include a dryer combined washing machine (a washer-dryer combo).

A dryer combined washing machine is a device that uses a driving force of a drive motor to agitate laundry, water, and detergent together in a tub, thereby washing by mutual friction.

Processes performed by a dryer combined washing machine may include a washing process of supplying a detergent and water to a tub in which laundry is accommodated and washing the laundry while rotating a drum, a rinsing process of supplying water to the tub and rinsing the laundry by rotating the drum, and a spin-drying process of discharging water from the tub and removing water from the laundry by rotating the drum.

The processes performed by the dryer combined washing machine may include a drying process to dry the laundry by blowing hot air generated from a drying device into a receiving space where the laundry is accommodated. The dryer combined washing machine may include a drying device to perform a drying process.

DISCLOSURE

Technical Solution

The disclosure provides a clothes care apparatus including a detergent supply device with a structure for preventing leakage.

The disclosure provides a clothes care apparatus and a method for controlling the same that may selectively supply water to at least one of a detergent supply device, a nozzle device, or a tub according to a washing process, a rinsing process, a spin-drying process or a drying process.

The disclosure provides a clothes care apparatus and a method for controlling the same that may prevent moisture leakage through a detergent supply device during a drying process.

According to an embodiment of the disclosure, a clothes care apparatus may include: a tub; an upper detergent supply device above the tub; a heat exchanger above the tub; a nozzle device configured to spray water to the heat exchanger to clean the heat exchanger; a water supply device to supply water, and including: a first pipe configured to guide water supplied by the water supply device to the upper detergent supply device, a second pipe configured to guide water supplied by the water supply device to the nozzle device, and a third pipe configured to guide water supplied by the water supply device to the tub; and a controller configured to control the water supply device to supply water to at least one of the first pipe to be guided to the upper detergent supply device, the second pipe to be guided to the nozzle device, or the third pipe to be guided to the tub, so as to perform at least one of a washing process, a rinsing process, a spin-drying process or a drying process.

The controller may be configured to control the water supply device to supply water to the third pipe to be guided to the tub, to block water from being supplied to the first pipe so as to prevent water from being guided to the upper detergent supply device, and to block water from being supplied to the second pipe so as to prevent water from being guided to the nozzle device, so as to perform the washing process.

The controller may be configured to control the water supply device to supply water to the first pipe to be guided to the upper detergent supply device, to supply water to the third pipe to be guided to the tub, and to block water from being supplied to the second pipe so as to prevent water from being guided to the nozzle device, so as to perform the rinsing process.

According to an embodiment of the disclosure, the clothes care apparatus may further comprise a door configured to open and close a laundry inlet on a side of the tub, wherein the third pipe may be further configured to guide water supplied by the water supply device to the door for cleaning the door, and the controller may be configured to control the water supply device to supply water to the third pipe to be guided to the door for cleaning the door, to block water from being supplied to the first pipe so as to prevent water from being guided to the upper detergent supply device, and to block water from being supplied to the second pipe so as to prevent water from being guided to the nozzle device for a predetermined door cleaning time, so as to clean the door based on a start of the spin-drying process.

The controller may be configured to, based on entering the drying process, control the water supply device to supply water to the first pipe to be guided to the upper detergent supply device, to block water from being supplied to the third pipe so as to prevent water from being guided to the tub, and to block water from being supplied to the second pipe so as to prevent water from being guided to the nozzle device for a predetermined period of time, so as to prevent moisture in the tub from leaking out of the tub.

According to an embodiment of the disclosure, the clothes care apparatus may further comprise a connection pipe having a U-shape and configured to connect the upper detergent supply device and the tub.

The controller may be configured to control the water supply device to supply water to the second pipe to be guided to the nozzle device, to block water from being supplied to the third pipe so as to prevent water from being guided to tub, and to block water from being supplied to the first pipe so as to prevent water from being supplied to the upper detergent supply device for a predetermined heat exchanger cleaning time before completion of the drying process.

The water supply device may further include: a first valve configured to control whether water supplied by the water supply device is guided by the first pipe, a second valve configured to control whether water supplied by the water supply device is guided by the second pipe, and a third valve configured to control whether water supplied by the water supply device is guided by the third pipe, and the controller may be configured to control the first valve, the second valve, and the third valve to supply water to at least one of the first pipe to be guided to the upper detergent supply device, the second pipe to be guided to the nozzle device, or the third pipe to be guided to the tub.

The controller may be configured to determine whether to perform at least one of the washing process, the rinsing process, the spin-drying process, or the drying process, based on an operation course selected by a user.

According to an embodiment of the disclosure, a clothes care apparatus may have a tub, an upper detergent supply device above the tub, a heat exchanger above the tub, a nozzle device configured to spray water to the heat exchanger to clean the heat exchanger, a water supply device to supply water, and including a first pipe configured to guide water supplied by the water supply device to the upper detergent supply device, a second pipe configured to guide water supplied by the water supply device to the nozzle device, and a third pipe configured to guide water supplied by the water supply device to the tub, and a controller, and a method for controlling a clothes care apparatus may include: determining an operation course of the clothes care apparatus based on a user input; determining to perform at least one of a washing process, a rinsing process, a spin-drying process, or a drying process, based on the determined operation course; controlling the water supply device to supply water to at least one of the first pipe to be guided to the upper detergent supply device, the second pipe to be guided to the nozzle device, or the third pipe to be guided to the tub, so as to perform the at least one of the washing process, the rinsing process, the spin-drying process, or the drying process that was determined to be performed.

The controlling the water supply device may further include controlling the water supply device to supply water to the third pipe to be guided to the tub, to block water from being supplied to the first pipe so as to prevent water from being guided to the upper detergent supply device, and to block water from being supplied to the second pipe so as to prevent water from being guided to the nozzle device, so as to perform the washing process.

The controlling the water supply device may further include controlling the water supply device to supply water to the third pipe to be guided to the tub, to supply water to the first pipe to be guided to the upper detergent supply device, and to block water from being supplied to the second pipe so as to prevent water from being guided to the nozzle device, so as to perform the rinsing process.

The clothes care apparatus may further include a door configured to open and close a laundry inlet on a side of the tub and the third pipe may be further configured to guide water supplied by the water supply device to the door for cleaning the door, and the controlling the water supply device may further include controlling the water supply device to supply water to the third pipe to be guided to the door for cleaning the door, to block water from being supplied to the second pipe so as to prevent water from being guided to the nozzle device, and to block water from being supplied to the first pipe so as to prevent water from being guided to the upper detergent supply device for a predetermined door cleaning time, so as to clean the door based on a start of the spin-drying process.

The controlling the water supply device may further include, based on entering the drying process, controlling the water supply device to supply water to the first pipe to be guided to the upper detergent supply device, to block water from being supplied to the third pipe so as to prevent water from being guided to the tub, and to block water from being supplied to the second pipe so as to prevent water from being guided to the nozzle device for a predetermined period of time, so as to prevent moisture in the tub from leaking out of the tub.

The controlling the water supply device may further include controlling the water supply device to supply water to the second pipe to be guided to the nozzle device, to block water from being supplied to the third pipe so as to prevent water from being guided to the tub, and to block water from being supplied to the first pipe so as to prevent water from being guided to the upper detergent supply device for a predetermined heat exchanger cleaning time before completion of the drying process.

According to the disclosure, a clothes care apparatus may prevent leakage through a detergent supply device.

According to the disclosure, a clothes care apparatus and a method for controlling the same may selectively supply water to at least one of a detergent supply device, a nozzle device, or a tub according to a washing process, a rinsing process, a spin-drying process or a drying process.

According to the disclosure, a clothes care apparatus and a method for controlling the same may prevent moisture leakage through a detergent supply device during a drying process.

DESCRIPTION OF DRAWINGS

FIG. 16 is a table illustrating a method for controlling a clothes care apparatus according to an embodiment of the disclosure.

MODES OF THE DISCLOSURE

Figure 1:
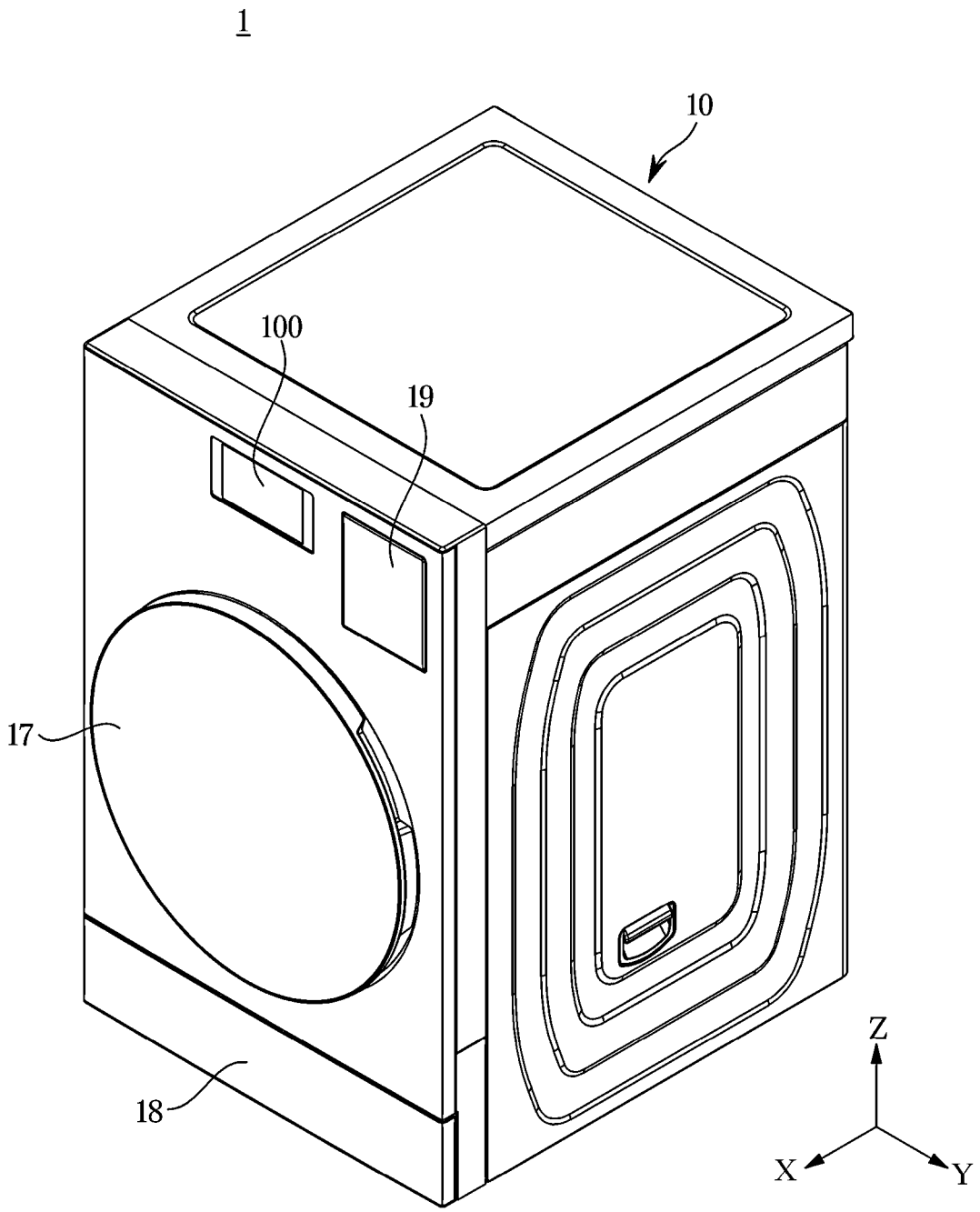
FIG. 1 illustrates a clothes care apparatus according to an embodiment of the disclosure.

Embodiments described in the specification and configurations shown in the accompanying drawings are merely examples of the disclosure, and various modifications may replace the embodiments and the drawings of the disclosure at the time of filing of the application.

Like reference numerals or symbols denoted in the drawings of the specification are members or components that perform the substantially same functions.

A singular form of a noun corresponding to an item may include one item or a plurality of the items unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

It will be understood that the terms "first", "second", or the like, may be used only to distinguish one component from another, not intended to limit the corresponding component in other aspects (e.g., importance or order).

When it is said that one (e.g., first) component is "coupled" or "connected" to another (e.g., second) component, with or without the terms "functionally" or "communicatively", it means that one component may be connected to the other component directly (e.g., by wire), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it may be directly on the other component or intervening components may also be present.

A washing machine according to various embodiments of the disclosure may perform washing, rinsing, spin-drying, and drying processes. The washing machine is an example of a clothes care apparatus, and the clothes care apparatus may be a concept including an apparatus capable of washing clothes (objects to be washed, and objects to be dried), an apparatus capable of drying clothes, and an apparatus capable of washing and drying clothes.

The washing machine according to various embodiments may include a top-loading washing machine in which a laundry inlet for inserting or withdrawing laundry is provided to face upward, or a front-loading washing machine in which a laundry inlet is provided to face forward. The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub.

Water may be supplied to the tub through the detergent supply device. Alternatively, water may be supplied to the tub without passing through the detergent supply device.

The water supply valve may open or close the water supply pipe in response to an electrical signal of a controller. The water supply valve may allow or block the supply of water to the tub from an external water supply source. The water supply valve may include a solenoid valve configured to open and close in response to an electrical signal.

The washing machine may include the detergent supply device configured to supply detergent to the tub. The detergent supply device may include a manual detergent supply device that requires a user to input detergent to be used for each washing, and an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with detergent via the detergent supply device. Water mixed with detergent may be supplied into the tub. The term "detergent" may include, for example, detergent for pre-washing, detergent for main washing, fabric softener, bleach, and the like. The detergent box may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal. The at least one input interface may include a power button, an operation button, a course selection dial (or a course selection button), and a washing/rinsing/spin-drying setting button. The at least one input interface may include, for example, a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user. For example, the at least one output interface may transmit information related to a washing process, operation time of the washing machine, and washing/rinsing/spin-drying settings to the user. Information about the operation of the washing machine may be output through a screen, an indicator, or voice. The at least one output interface may include, for example, a Liquid Crystal Display (LCD) panel, a Light Emitting Diode (LED) panel, or a speaker.

The washing machine may include a communication module for wired and/or wireless communication with an external device.

The communication module may include at least one of a short-range wireless communication module or a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to an embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, a Zigbee communication module, an Infrared Data Association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, or a server on a mobile communication network.

According to an embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The controller may control various components of the washing machine (e.g., the drive motor, and the water supply valve). The controller may control various components of the washing machine to perform at least one operation including water supply, washing, rinsing, and/or spin-drying according to a user input. For example, the controller may control the drive motor to adjust a rotational speed of the drum or control the water supply valve of the water supply device to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter, a clothes care apparatus according to various embodiments of the disclosure will be described in detail with reference to the accompanying drawings. Hereinafter, a dryer combined washing machine (a washer-dryer combo) is described as an example of the clothes care apparatus, but the disclosure is not limited thereto. A variety of apparatuses for treating and/or caring for clothes may be used as the clothes care apparatus.

The terms "front," "rear," "left," "right," etc., used in the following description are defined based on the drawings, and the shape and position of each component are not limited by these terms.

For example, an X-axis direction may be defined as a front-to-back direction, a Y-axis direction may be defined as a left-right direction, and a Z-axis direction may be defined as an up-down direction.

Figure 2:
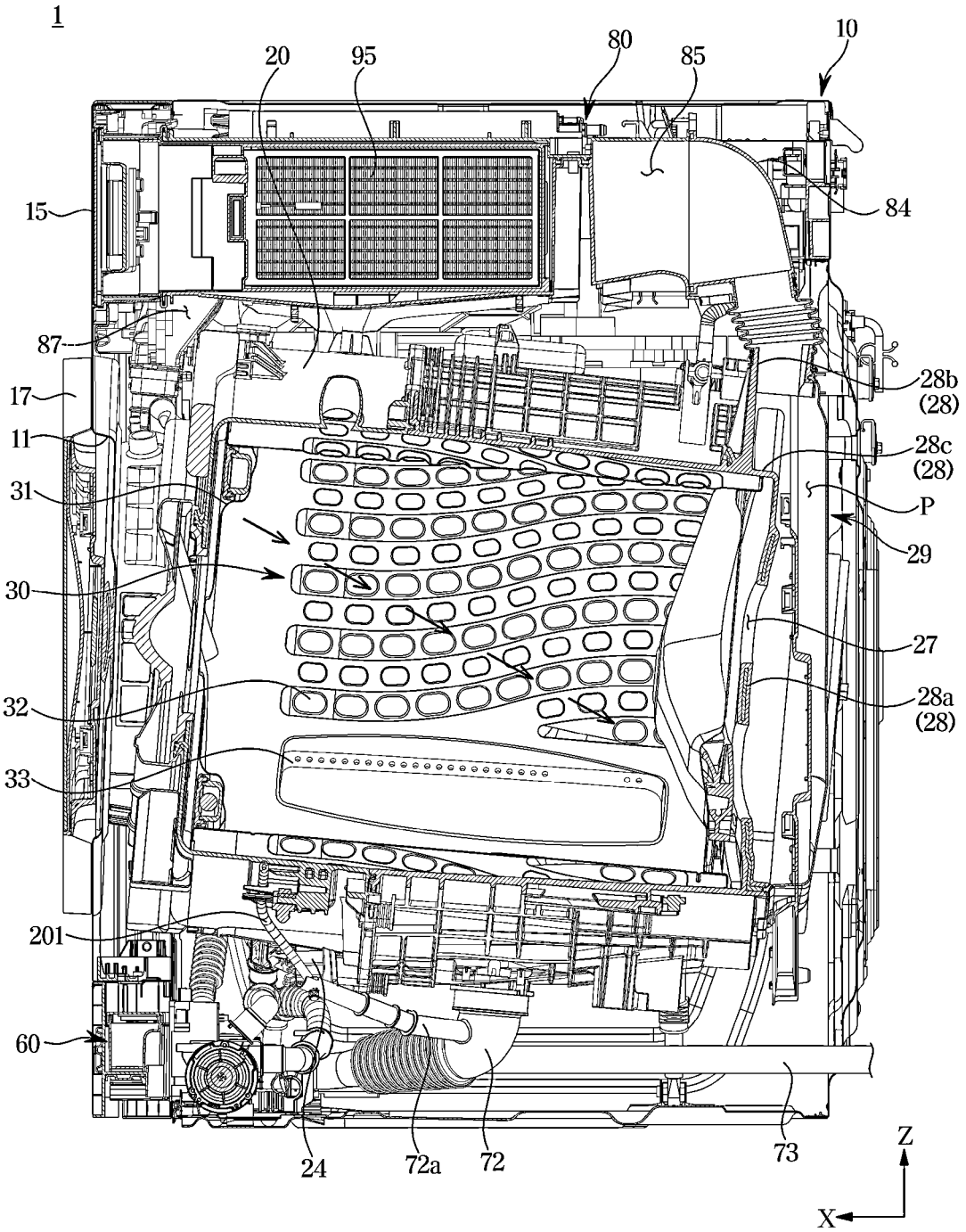
FIG. 2 is a cross-sectional view of a clothes care apparatus according to an embodiment of the disclosure.
Figure 3:
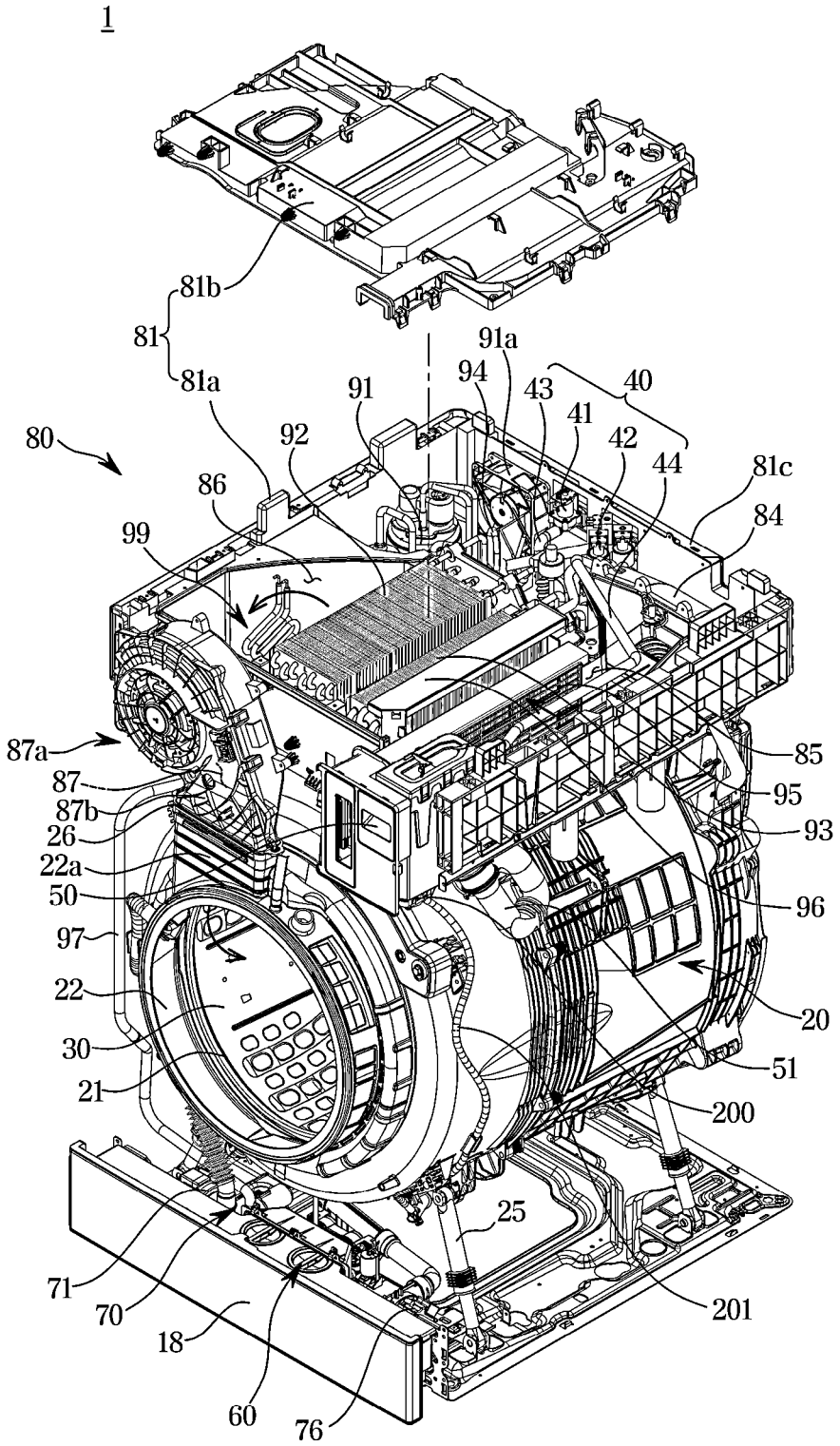
FIG. 3 illustrates a portion of components disposed in a clothes care apparatus according to an embodiment of the disclosure.
Figure 4:
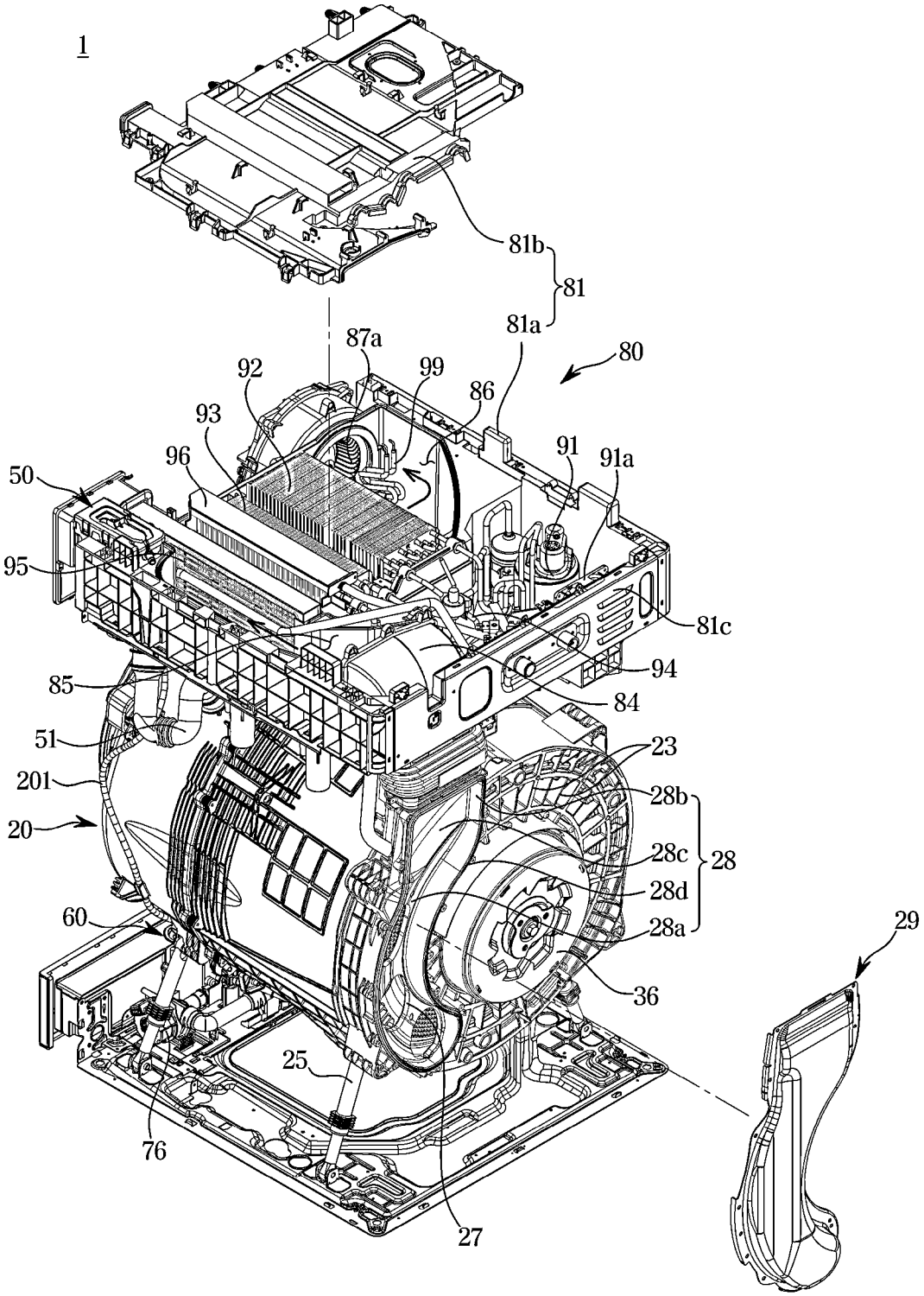
FIG. 4 illustrates a portion of components disposed in a clothes care apparatus in a direction different from FIG. 3 according to an embodiment of the disclosure.
Figure 5:
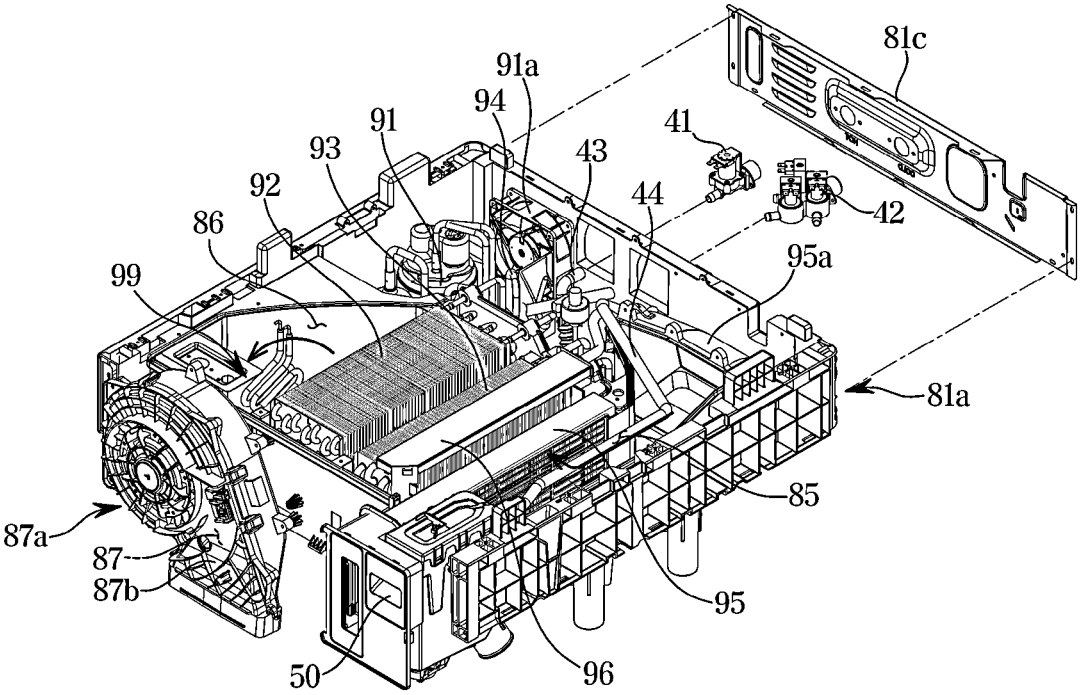
FIG. 5 is an exploded view of a portion of components of a drying device according to an embodiment of the disclosure.

FIG. 1 illustrates a clothes care apparatus according to an embodiment of the disclosure. FIG. 2 is a cross-sectional view of a clothes care apparatus according to an embodiment of the disclosure. FIG. 3 illustrates a portion of components disposed in a clothes care apparatus according to an embodiment of the disclosure. FIG. 4 illustrates a portion of components disposed in a clothes care apparatus in a direction different from FIG. 3 according to an embodiment of the disclosure. FIG. 5 is an exploded view of a portion of components of a drying device according to an embodiment of the disclosure.

Referring to FIG. 1 to FIG. 5, a clothes care apparatus 1 according to various embodiments of the disclosure may include a housing 10 for accommodating various components therein. The housing 10 may be provided in the form of a box including a laundry inlet 11 on one side thereof. The laundry inlet 11 may be provided to face approximately forward.

The clothes care apparatus 1 may include a laundry door 17 for opening and closing the laundry inlet 11. The laundry door 17 may be rotatably mounted to the housing 10 by a hinge. At least a portion of the laundry door 17 may be transparent or translucent to allow the inside of the housing to be seen. For example, the laundry door 17 may include tempered glass.

The clothes care apparatus 1 may include a lower door 18 to provide access to a lower detergent supply device 60. The clothes care apparatus 1 may include an upper door 19 to provide access to an upper detergent supply device 50 and a filter 95.

The clothes care apparatus 1 may include a tub 20 arranged inside the housing 10 to store water. The tub 20 may be formed in a substantially cylindrical shape with a tub opening 21 formed at one side thereof. The tub may be disposed inside the housing 10 in such a way that the tub opening 21 corresponds to the laundry inlet 11. The tub opening 21 may be provided to substantially face forward. The laundry door 17 may open or close the tub opening 21.

The tub 20 may be connected to the housing 10 by a damper 25. The damper 25 may absorb vibration generated when a drum 30 rotates, and the damper 25 may reduce vibration transmitted to the housing 10.

The clothes care apparatus 1 may include the drum 30 to accommodate laundry. At least one lifter 33 may be installed in the drum 30 to lift and drop laundry to wash the laundry.

The drum 30 may be disposed inside the tub 20 in such a way that a drum opening 31 corresponds to the laundry inlet 11 and the tub opening 21. Laundry may sequentially pass through the laundry inlet 11, the tub opening 21, and the drum opening 31, and then be accommodated in the drum 30 or withdrawn from the drum 30. The drum opening 31 may be provided to substantially face forward.

The drum 30 may perform each operation according to washing, rinsing, and/or spin-drying while rotating inside the tub 20. A plurality of through holes 32 may be formed in a cylindrical wall of the drum 30 to allow water stored in the tub 20 to be introduced into or to be withdrawn from the drum 30.

The clothes care apparatus 1 may include a driving device 36 configured to rotate the drum 30. The driving device 36 may include a drive motor **36*a* and a rotating shaft for transmitting a driving force generated by the drive motor 36*a* to the drum 30. The rotating shaft may penetrate the tub 20 to be connected to the drum 30**.

The driving device 36 may perform respective operations according to washing, rinsing, and/or spin-drying, or drying processes by rotating the drum 30 in a forward or reverse direction.

The clothes care apparatus 1 may include a water supply device 40. The water supply device 40 may include water supply valves 41 and 42 that may be connected to an external water supply source. For example, the water supply valves 41 and 42 may include the first water supply valve 41 for supplying hot water and the second water supply valve 42 for supplying cold water. The first water supply valve 41 may be referred to as a hot water supply valve. The second water supply valve 42 may be referred to as a cold water supply valve.

The water supply device 40 may include water supply pipes 43 and 44 and the water supply valves 41 and 42. The water supply pipes 43 and 44 may be provided as a flexible hose, plastic pipe, or metal pipe. The water supply pipes 43 and 44 may be connected to the water supply valves 41 and 42. For example, the water supply pipes 43 and 44 may include the first water supply pipe 43 connected to the first water supply valve 41 and the second water supply pipe 44 connected to the second water supply valve 42. The first water supply pipe 43 may be referred to as a hot water pipe. The second water supply pipe 44 may be referred to as a cold water pipe.

At least one of the water supply pipes 43 and 44 may guide water from the water supply valves 41 and 42 to the tub 20. At least one of the water supply pipes 43 and 44 may extend from the water supply valve 42 to the tub 20. Water may be supplied to the lower detergent supply device 60 through the tub 20. Water may be supplied to the lower detergent supply device 60 without passing through the tub 20.

The water supply valves 41 and 42 may open or close the water supply pipes 43 and 44. The water supply valves 41 and 42 may allow or block the supply of water to the tub 20 from an external water supply source. For example, the water supply valves 41 and 42 may include a solenoid valve configured to open and close in response to an electrical signal.

The clothes care apparatus 1 may include detergent supply devices 50 and 60 to supply detergent to the tub 20. The detergent supply devices 50 and 60 may include the upper detergent supply device 50 and the lower detergent supply device 60. The term "detergent" may include, for example, detergent for pre-washing, detergent for main washing, fabric softener, bleach, and the like.

The upper detergent supply device 50 may be positioned above the tub 20. The upper detergent supply device 50 may be located above the tub 20 in a vertical direction. The upper detergent supply device 50 may include a manual detergent supply device that requires a user to input detergent to be used for each washing, or an automatic detergent supply device that stores a large amount of detergent and automatically inputs a predetermined amount of detergent during washing. The upper detergent supply device 50 may be connected to the tub 20 through a detergent connection pipe 51. For example, the upper detergent supply device 50 may supply solid laundry detergent and/or softener to the tub 20. However, the type of detergent is not limited to the above examples.

The detergent connection pipe 51 may be in the form of a U-shape. The detergent connection pipe 51 may be provided as a flexible hose, plastic pipe, or metal pipe. One end of the detergent connection pipe 51 may be connected to the upper detergent supply device 50, and the other end of the detergent connection pipe 51 may be connected to the tub 20. In the vertical direction relative to the ground, one end and the other end of the detergent connection pipe 51 may be at a higher position than a bent portion of the detergent connection pipe 51. Accordingly, water may accumulate in the bent portion of the detergent connection pipe 51. Water accumulating in the bent portion of the detergent connection pipe 51 may prevent moisture in the tub 20 from being discharged to the outside through the upper detergent supply device 50.

The lower detergent supply device 60 may be positioned below the tub 20. The lower detergent supply device 60 may be located below the tub 20 in a vertical direction. The lower detergent supply device 60 may include a manual detergent supply device that requires a user to input detergent to be used for each washing, or an automatic detergent supply device that stores a large amount of detergent and automatically inputs a predetermined amount of detergent during washing. For example, the lower detergent supply device 60 may supply liquid laundry detergent and/or softener to the tub 20. However, the type of detergent is not limited to the above examples.

The clothes care apparatus 1 may include a drainage device 70 to discharge water contained in the tub 20 to the outside. The drainage device 70 may include a drain pump 71 to discharge the water in the tub 20 to the outside of the housing 10.

The clothes care apparatus 1 may include a circulation pump 76 to circulate water in the tub 20 back to the tub 20 through the lower detergent supply device 60.

The drainage device 70 may be connected to the tub 20 through a tub connection pipe 72. The drainage device 70 may discharge water from the tub 20 to the outside of the housing 10 through a drain pipe 73.

The clothes care apparatus 1 may include a water level sensor 200 for detecting a water level of the tub 20. The water level sensor 200 may be located outside the tub 20. For example, the water level sensor 200 may be installed below the upper detergent supply device 50. The location of the water level sensor 200 is not limited thereto.

The water level sensor 200 may be connected to a connection hose 201 extending from a branch pipe 72*a* of the tub connection pipe 72. The water level sensor 200 may be installed at an end of the connection hose 201 connected to the tub connection pipe 72. A water level of the connection hose 201 may be the same as that of the tub 20.

As the water level in the tub 20 increases, the water level in the connection hose 201 increases. An increase in the water level in the connection hose 201 may increase a pressure in the connection hose 201. The water level sensor 200 may detect pressure changes in the connection hose 201 and may detect the water level in the tub 20 corresponding to the pressure in the connection hose 201. The water level sensor 200 may generate an electrical signal corresponding to the pressure in the connection hose 201. A frequency of the electrical signal generated by the water level sensor 200 may vary depending on pressure changes in the connection hose 201.

In another example, the water level sensor 200 may be installed inside the tub 20. As the water level in the tub 20 increases, a pressure applied to the water level sensor 200 may increase. The water level sensor 200 may detect the water level in the tub 20 corresponding to the pressure.

The clothes care apparatus 1 may include a control panel 100 disposed on one side of the housing 10. The control panel 100 may provide a user interface for interaction between a user and the clothes care apparatus 1. The user interface may include at least one input interface 101 and at least one output interface 102.

For example, the at least one input interface 101 may convert sensory information received from a user into an electrical signal. The at least one input interface 101 may include a power button, an operation button, a course selection dial (or a course selection button), and a washing/rinsing/spin-drying setting button. The at least one input interface 101 may include a tact switch, a push switch, a slide switch, a toggle switch, a micro switch, a touch switch, a touch pad, a touch screen, a jog dial, and/or a microphone.

The at least one output interface 102 may visually or audibly transmit information related to the operation of the clothes care apparatus 1 to a user. For example, the at least one output interface 102 may transmit information related to a washing process, operation time of the clothes care apparatus 1, and washing/rinsing/spin-drying settings to the user. Information about the operation of the clothes care apparatus 1 may be output through a screen, an indicator, or voice. The at least one output interface 102 may include, for example, a Liquid Crystal Display (LCD) panel, a Light Emitting Diode (LED) panel, or a speaker.

The clothes care apparatus 1 may include a drying device 80 to dry the laundry accommodated in the drum 30. The drying device 80 may heat air and supply the heated air to the inside of the tub 20. The drying device 80 may dry and heat the air discharged from the tub 20, and circulate the dried and heated air inside the tub 20 to dry the laundry in the drum 30. The drying device 80 according to various embodiments may be disposed above the tub 20.

The drying device 80 may include a drying case 81. The drying case 81 may include a drying base 81*a* and a drying cover 81*b* coupled to the drying base 81*a* to form a flow path through which air may pass. The drying cover 81*b* may cover an open upper surface of the drying base 81*a*.

Referring to FIG. 5, for example, the drying device 80 may include a rear cover 81*c* that may be coupled to a rear side of the drying base 81*a*. The rear cover 81*c* may form at least a portion of the rear of the drying device 80. The water supply valves 41 and 42 may be mounted to the rear cover 81*c*.

The drying device 80 may be configured as a heat pump type. The drying device 80 may include a fan 87*a*, a compressor 91, a condenser 92, an evaporator 93, an expansion valve, and a refrigerant pipe 94 for allowing a refrigerant to circulate. The compressor 91, the condenser 92, the evaporator 93, and the expansion valve, that constitute the heat pump, may be disposed in the drying case 81. For example, the drying device 80 may further include a cooling fan 91*a* for cooling the compressor 91. For example, the drying device 80 may be formed as a single module.

The compressor 91 may compress the refrigerant, and the compressed high-temperature and high-pressure refrigerant may move to the condenser 92. The condenser 92 may cool the refrigerant to heat the surrounding air. The heated air may flow into the drum 30 to dry laundry.

The refrigerant expanded through the expansion valve may absorb heat from the evaporator 93 and cool the surrounding air. That is, the evaporator 93 may remove moisture by cooling the high-temperature and humid air that has passed through the inside of the drum 30. The air from which moisture has been removed may pass through the condenser 92, and may be heated again while exchanging heat with the refrigerant in the condenser 92. That is, the condenser 92 may heat the air that has passed through the evaporator 93. The condenser 92 and the evaporator 93 may correspond to a heat exchanger. The condenser 92 may be referred to as a 'first heat exchanger'. The evaporator 93 may be referred to as a 'second heat exchanger'.

For example, the drying device 80 may further include a drying heater 99. The drying heater 99 may increase a drying efficiency of the drying device 80. The heat pump components of the drying device 80 may be replaced with the drying heater 99.

The drying heater 99 may heat the air introduced into the drying device 80. The drying heater 99 may be disposed in a heating flow path 86. The drying heater 99 may be disposed downstream of the condenser 92 along a flow of air passing through the drying device 80. In addition, the drying heater 99 may be provided in a relatively small size to reduce flow path resistance. For example, the drying heater 99 may be a sheath heater.

The drying device 80 according to various embodiments may be disposed above the tub 20. An inlet flow path 85 into which the air discharged from the tub 20 flows may be formed in the drying device 80. The heating flow path 86 may be formed in the drying device 80 for heat exchange of the air introduced into the drying device 80 through the inlet flow path 85. The drying device 80 may be provided with a supply flow path 87 through which the air heat-exchanged while passing through the heating flow path 86 is supplied to the tub 20.

The inlet flow path 85 may allow the air passing through the inside of the tub 20 to flow into the drying device 80. The inlet flow path 85 may be disposed above the tub 20. The inlet flow path 85 may communicate with an exhaust flow path P formed at the rear of the tub 20.

The drying device 80 may include an inlet guide 84 connected to the tub 20. The inlet guide 84 may guide the air discharged from the tub 20 to the inlet flow path 85. The inlet flow path 85 may communicate with the exhaust flow path P formed in the tub 20 through the inlet guide 84. The air that has passed through the exhaust flow path P may flow into the inlet flow path 85 of the drying device 80 through the inlet guide 84.

The filter 95 may be disposed in the inlet flow path 85 to filter out foreign substances, such as lint, contained in the air flowing in from the tub 20 through the exhaust flow path P. The air flowing into the inlet flow path 85 may flow into the heating flow path 86 after passing through the filter 95. The filter 95 may be located on a flow path through which air flowing into the drying device 80 moves to the evaporator 93 and the condenser 92.

The heat exchangers 92 and 93 may be disposed on the heating flow path 86. The heat exchangers 92 and 93 may include the condenser 92 and the evaporator 93. Because the air flowing into the heating flow path 86 has already passed through the inside of the tub 20, the introduced air may be humid. The humid air may be cooled in the evaporator 93 disposed in the heating flow path 86 to remove moisture. The air from which moisture has been removed in the evaporator 93 may pass through the condenser 92 and may be heated again.

The drying device 80 may include a nozzle device 96 to clean the heat exchangers 92 and 93. The nozzle device 96 may be arranged in the heating flow path 86. The nozzle device 96 may receive water from the water supply device 40 and may spray water toward the heat exchangers 92 and 93. The water sprayed from the nozzle device 96 may clean one side of the heat exchangers 92 and 93.

Meanwhile, the clothes care apparatus 1 may include a drain line 97 to guide the water discharged from the drying device 80 to the tub 20. The drain line 97 may be provided as a flexible hose, plastic pipe, or metal pipe. The drain line 97 may guide condensate water generated in the heat exchangers 92 and 93 of the drying device 80 to the outside of the drying device 80. The drain line 97 may guide the water sprayed by the nozzle device 96 for cleaning the heat exchangers 92 and 93 to the outside of the drying device 80.

The nozzle device 96 may clean the heat exchangers 92 and 93. The nozzle device 96 may be configured to clean an area where air of the heat exchangers 92 and 93 is introduced. The nozzle device 96 may be configured to clean at least a portion of the evaporator 93. The nozzle device 96 may be configured to clean a portion of the evaporator 93 into which air passing through the filter 95 flows. The nozzle device 96 may be configured to clean a portion of the evaporator 93 that is contaminated by air that exchanges heat with the evaporator 93 while passing through the evaporator 93. The nozzle device 96 may be located adjacent to an area where air of the evaporator 93 is introduced.

The drain line 97 may be connected to the drainage device 70. The drain line 97 may be connected to the drain pump 71. Water discharged from the drying device 80 may flow to the drainage device 70 along the drain line 97. Water flowing into the drainage device 70 through the drain line 97 may be guided to the tub 20. Condensate water flowing into the tub 20 may be discharged to the outside of the clothes care apparatus 1 by an operation of the drain pump 71.

The supply flow path 87 may supply the air, heated while passing through the condenser 92, back to the inside of the tub 20. The supply flow path 87 may communicate with the heating flow path 86 and extend downward to discharge the heated air toward an opening of the tub 20.

The fan 87*a* may be provided on the supply flow path 87 to allow air to flow into the tub 20. That is, the fan 87*a* may supply air to the laundry in the drum 30. For example, the fan 87*a* may include a sirocco fan.

The inlet flow path 85, the heating flow path 86, and the supply flow path 87 may cause air to circulate into the inside of the tub 20 and the drying device 80.

In the clothes care apparatus 1, air discharged from the tub 20 may sequentially pass through the inlet flow path 85, the heating flow path 86, and the supply flow path 87 of the drying device 80 located above the tub 20, and then may be supplied into the tub 20.

The air heated in the drying device 80 may flow into the drum 30. In order to secure an area where the heated air supplied into the drum 30 comes into contact with the laundry, a tub exhaust port 27 may be disposed at a position opposite to an air inlet 26 through which the air heated in the drying device 80 flows into the tub 20. In order to increase a distance and/or time for the heated air to flow inside the drum 30 to allow the heated air to come into more contact with the laundry, the tub exhaust port 27 may be disposed at a position opposite to the air inlet 26 through which the air heated in the drying device 80 flows into the tub 20. The supply flow path 87 for supplying the heated air into the drum 30 and the tub exhaust port 27 may be arranged to be spaced apart from each other. By increasing the area of contact between the heated air and the laundry, drying efficiency may be improved.

The air inlet 26 and the tub exhaust port 27 may be arranged to maximize the use of heated air provided from the drying device 80. For example, the air inlet 26 may be located adjacent to the front of the tub 20, and the tub exhaust port 27 may be located adjacent to the rear of the tub 20.

Referring to FIG. 3, the washing machine according to an embodiment may include a diaphragm 22 connecting the tub opening 21 of the tub 20 and the laundry inlet 11 of the housing 10. The diaphragm 22 may connect the laundry inlet 11 and the tub opening 21. The diaphragm 22 may prevent the laundry put into the laundry inlet 11 from falling between the housing 10 and the tub 20, and may function to connect a front end of the tub 20 and the housing regardless of vibrations occurring during a washing process. To this end, the diaphragm 22 may be formed of an elastic material. For example, the diaphragm 22 may include a plastic material such as rubber or Thermo Plastic Elastomer (TPE).

In the washing machine according to an embodiment, the diaphragm 22 may include a duct portion 22*a* provided to be connected to a supply duct 87*b* forming the supply flow path 87. The duct portion 22*a* may extend upward from a side of the diaphragm 22 having a cylindrical shape with both sides open. A flow path may be formed inside the duct portion 22*a* to allow air to flow. The duct portion 22*a* may be formed adjacent to an upper end of the diaphragm 22. The duct portion 22*a* may be formed integrally with the diaphragm 22 and have the same material. Alternatively, the duct portion 22*a* may be provided separately from the diaphragm 22 and may be coupled to the diaphragm 22. In addition, the duct portion 22*a* may be provided separately from the diaphragm 22 and the tub 20 and may be coupled to the tub 20. The duct portion 22*a* may be formed integrally with the tub 20. The air inlet 26 may be formed at one end of the duct portion 22*a*.

The clothes care apparatus 1 according to various embodiments may further include the exhaust flow path P to allow the air discharged from the inside of the tub 20 to flow to the drying device 80. The exhaust flow path P may be arranged to allow air discharged from the tub exhaust port 27 to flow into the inlet flow path 85 of the drying device 80. The exhaust flow path P may be arranged to discharge the humid air that has passes through the tub 20. For example, the exhaust flow path P may be provided at the rear of the tub 20

The air in the tub 20 may be discharged to a tub duct 28 through the tub exhaust port 27 formed at the rear of the tub 20. The air discharged from the tub duct 28 may flow along the exhaust flow path P and be supplied to the drying device 80.

The clothes care apparatus 1 according to various embodiments may include the tub duct 28 to form a portion of the exhaust flow path P. For example, the tub duct 28 may be formed integrally with the tub 20. For example, the tub 20 may include the tub duct 28. The tub duct 28 may surround the tub exhaust port 27.

The clothes care apparatus 1 according to various embodiments may include a duct cover 29 to form a portion of the exhaust flow path P. The duct cover 29 may cover an open rear side of the tub duct 28. For example, the tub 20 may include the duct cover 29. The duct cover 29 may form at least a portion of the exhaust flow path P through which the air discharged through the tub exhaust port 27 flows to the drying device 80.

In the clothes care apparatus 1 according to various embodiments, the exhaust flow path P may be formed by coupling the duct cover 29 and the tub duct 28.

The tub duct 28 according to an embodiment may include a recess portion 28*a* that forms a portion of the exhaust flow path P through which the air discharged from the inside of the tub 20 flows. A reinforcing rib 23 may be arranged on a rear surface of the tub 20 to reinforce a rigidity of the tub 20. The recess portion 28*a* may be recessed from an end of the reinforcing rib 23 protruding from the rear surface of the tub 20. The recess portion 28*a* may be a portion of the rear surface of the tub 20 where the reinforcing rib 23 is not formed. The tub exhaust port 27 may be formed in the recess portion 28*a* to discharge air from the inside of the tub 20. The tub duct 28 may include a partition rib 28*d* provided along a circumference of the recess portion 28*a*. The partition rib 28*d* may distinguish an area where the reinforcing rib 23 is formed and an area where the recess portion 28*a* is formed, in the rear surface of the tub 20.

The tub 20 according to an embodiment may include a duct connection portion 28*b* that forms another portion of the exhaust flow path P through which air passing through the recess portion 28*a* flows. The duct connection portion 28*b* may protrude outwardly in a radial direction from an outer circumferential surface of the tub 20. The duct connection portion 28*b* may protrude approximately upward from the outer circumferential surface of the tub 20. For example, the duct connection portion 28*b* may protrude upward from a rear end of the tub 20. However, the duct connection portion 28*b* is not limited thereto, and the duct connection portion 28*b* may be located at various positions depending on a location of the drying device 80.

The duct connection portion 28*b* may connect the tub duct 28 and the inlet guide 84 of the drying device 80. The duct connection portion 28*b* may extend the exhaust flow path P upward. The duct connection portion 28*b* may form a portion of the exhaust flow path P together with the recess portion 28*a*, the partition rib 28*d*, and the duct cover 29.

The duct connection portion 28*b* may be formed in a rectangular parallelepiped shape with an open top and rear surface. The duct cover 29 may cover an open rear side of the duct connection portion 28*b*. Only one side of the exhaust flow path may be formed by the duct cover 29, thereby facilitating coupling and sealing structure.

The duct cover 29 may cover the tub duct 28 and the duct connection portion 28*b*. The duct cover 29 may cover one open side of the tub duct 28 and the open rear side of the duct connection portion 28*b*. The duct cover 29 covers the recess portion 28*a* and the duct connection portion 28*b*, and thus the exhaust flow path P may be formed. Because the exhaust flow path P is connected to the inlet flow path 85, the air flowing into the exhaust flow path P through the tub exhaust port 27 may move along the exhaust flow path P, and may flow into the drying device 80 through the inlet flow path 85.

Although not illustrated, the duct connection portion 28*b* may be provided in a rectangular parallelepiped shape with only an upper surface open for air discharge and a rear surface closed. In this case, the duct cover 29 may cover only the tub duct 28.

Meanwhile, the duct connection portion 28*b* according to an embodiment of the disclosure may be included in the tub duct 28. The duct connection portion 28*b* of the tub duct 28 according to an embodiment may extend from the recess portion 28*a* to the inlet guide 84. The tub duct 28 may be connected to the inlet guide 84 by the duct connection portion 28*b*. Hereinafter, the duct connection portion 28*b* according to an embodiment of the disclosure may be described as being included in the tub duct 28.

The tub duct 28 may include a step portion 28*c* to expand a cross-sectional area of the exhaust flow path P. The exhaust flow path P may be provided in such a way that a width of an area formed by the duct connection portion 28*b* is larger than a width of an area formed in the recess portion 28*a* by the step portion 28*c*.

The arrangement of the water supply valves 41 and 42 of the clothes care apparatus 1 may be determined by using a remaining space due to the above-described mounting structure. In an embodiment, the water supply valves 41 and 42 may be mounted between the inlet guide 84 and a cooling fan 91*a*. The water supply valves 41 and 42 may be located in a center of the rear surface of the drying device 80. The water supply valves 41 and 42 may be located behind the condenser 92. The water supply valves 41 and 42 may be located in an area separated from a flow path through which dry air flows. The positions of the water supply valves 41 and 42 are not limited the above.

The clothes care apparatus 1 may include a wash water heater 24. The wash water heater 24 may be arranged below the tub 20 and may heat wash water during washing. In addition, the water supply device 40 may supply a predetermined amount of water to a lower side of the tub 20 through the exhaust flow path P during a drying process. The wash water heater 24 may heat the water supplied into the tub 20 through the water supply device 40, the exhaust flow path P, and the tub exhaust port 27 to generate steam. That is, the steam generated by the water supply device 40 and the wash water heater 24 may come into contact with the laundry during the drying process, thereby preventing formation of wrinkles on the laundry.

That is, unlike existing dryers, the clothes care apparatus 1 as a dryer combined washing machine may include the wash water heater 24 for heating wash water, and may use the wash water heater 24 and the water supply device 40 for cleaning the exhaust flow path P to generate steam, thereby preventing formation of wrinkles on the laundry during the drying process.

Figure 6:
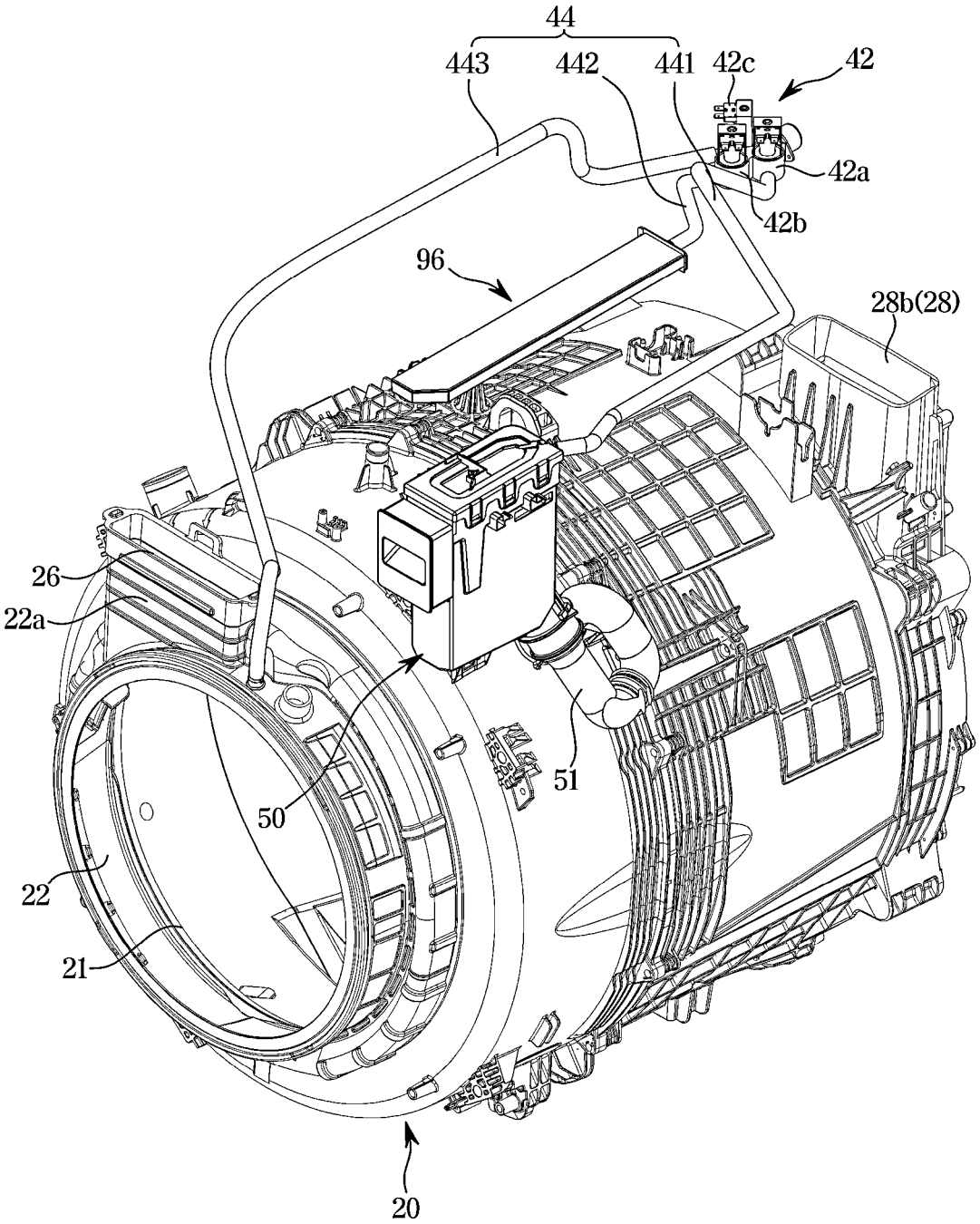
FIG. 6 illustrates a portion of components related to water supply of a clothes care apparatus according to an embodiment of the disclosure.

FIG. 6 illustrates a portion of components related to water supply of a clothes care apparatus according to an embodiment of the disclosure.

Hereinafter, in the clothes care apparatus 1 according to an embodiment, the second water supply valve 42 is described as being connected to the upper detergent supply device 50, the nozzle device 96, and the tub 20, but the disclosure is not limited thereto. The second water supply valve 42 may be connected to at least one of the upper detergent supply device 50, the nozzle device 96, or the tub 20. Also, the first water supply valve 41 may be connected to at least one of the upper detergent supply device 50, the nozzle device 96, or the tub 20.

For convenience of description, the second water supply valve 42 may be referred to as a 'water supply valve', the second water supply pipe 44 may be referred to as a 'water supply pipe', and the upper detergent supply device 50 may be referred to as a 'detergent supply device.'

Referring to FIG. 6, the water supply pipe 44 according to an embodiment may include a first pipe 441, a second pipe 442, and a third pipe 443. The first pipe 441, the second pipe 442, and the third pipe 443 may be provided as a flexible hose, plastic pipe, or metal pipe. The first pipe 441 may also be referred to as a first connection pipe. The second pipe 442 may be referred to as a second connection pipe. The third pipe 443 may be referred to as a third connection pipe.

The first pipe 441 may connect the water supply valve 42 and the upper detergent supply device 50. The water supply valve 42 may be controlled to supply at least a portion of water provided from an external water supply source to the upper detergent supply device 50 through the first pipe 441. The first pipe 441 may guide the water supplied from an external water supply source to the upper detergent supply device 50. The first pipe 441 may form a flow path for flow of water from the water supply valve 42 to the upper detergent supply device 50.

The second pipe 442 may connect the water supply valve 42 and the nozzle device 96. The water supply valve 42 may be controlled to supply at least a portion of water provided from an external water supply source to the nozzle device 96 through the second pipe 442. The second pipe 442 may guide water supplied from an external water supply source to the nozzle device 96. The second pipe 442 may form a flow path for flow of water from the water supply valve 42 to the nozzle device 96.

The third pipe 443 may connect the water supply valve 42 and the tub 20. The water supply valve 42 may be controlled to supply at least a portion of water provided from an external water supply source to the tub 20 through the third pipe 443. The third pipe 443 may guide water supplied from an external water supply source to an upper front end of the tub 20. The third pipe 443 may form a flow path for flow of water from the water supply valve 42 to the tub 20. The third pipe 443 may be connected to a portion of the diaphragm 22. The third pipe 443 may be connected to a portion of the diaphragm 22 adjacent to the air inlet 26.

In an embodiment, the water supply valve 42 may include a plurality of valves. For example, the water supply valve 42 may include a first valve 42*a*, a second valve 42*b*, and a third valve 43*c*. The first valve 42*a* may be connected to the first pipe 441. The second valve 42*b* may be connected to the second pipe 442. The third valve 43*c* may be connected to the third pipe 443. Once the first valve 42*a* is opened, water may be supplied to the detergent supply device 50 through the first pipe 441. Once the second valve 42*b* is opened, water may be supplied to the nozzle device 96 through the second pipe 442. Once the third valve 43*c* is opened, water may be supplied to the tub 20 through the third pipe 443. The first valve 42*a*, the second valve 42*b*, and the third valve 43*c* may be controlled by the controller 300.

In an embodiment, the water supply valve 42 may correspond to a 4-way valve. A movable piston assembly may be provided in the water supply valve 42 to guide water from an external water supply source to at least one of the first pipe 441, the second pipe 442, or the third pipe 443. That is, a flow path switching structure may be provided inside the water supply valve 42. The water supply valve 42 may be controlled to guide water to at least one of the first pipe 441, the second pipe 442, or the third pipe 443.

The upper detergent supply device 50 may be connected to the tub 20 through the detergent connection pipe 51. The detergent connection pipe 51 may be provided in the form of a U-shape. One end of the detergent connection pipe 51 may be connected to the upper detergent supply device 50, and the other end of the detergent connection pipe 51 may be connected to the tub 20. In the vertical direction relative to the ground, one end and the other end of the detergent connection pipe 51 may be at a higher position than the bent portion of the detergent connection pipe 51. Accordingly, water may accumulate in the bent portion of the detergent connection pipe 51. Water accumulating in the bent portion of the detergent connection pipe 51 may prevent moisture in the tub 20 from being discharged to the outside through the upper detergent supply device 50.

Figure 7:
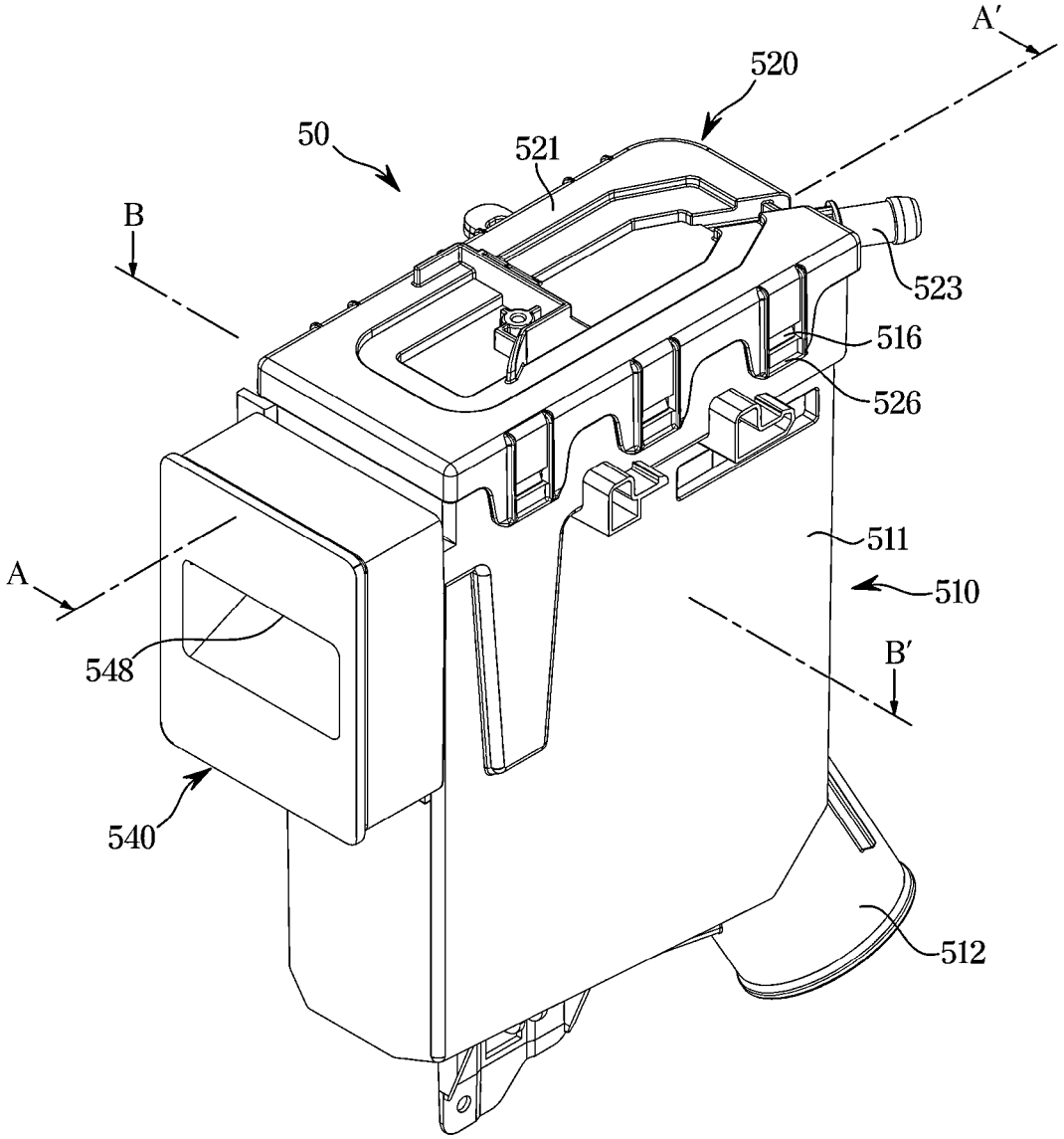
FIG. 7 illustrates a detergent supply device according to an embodiment of the disclosure.
Figure 8:
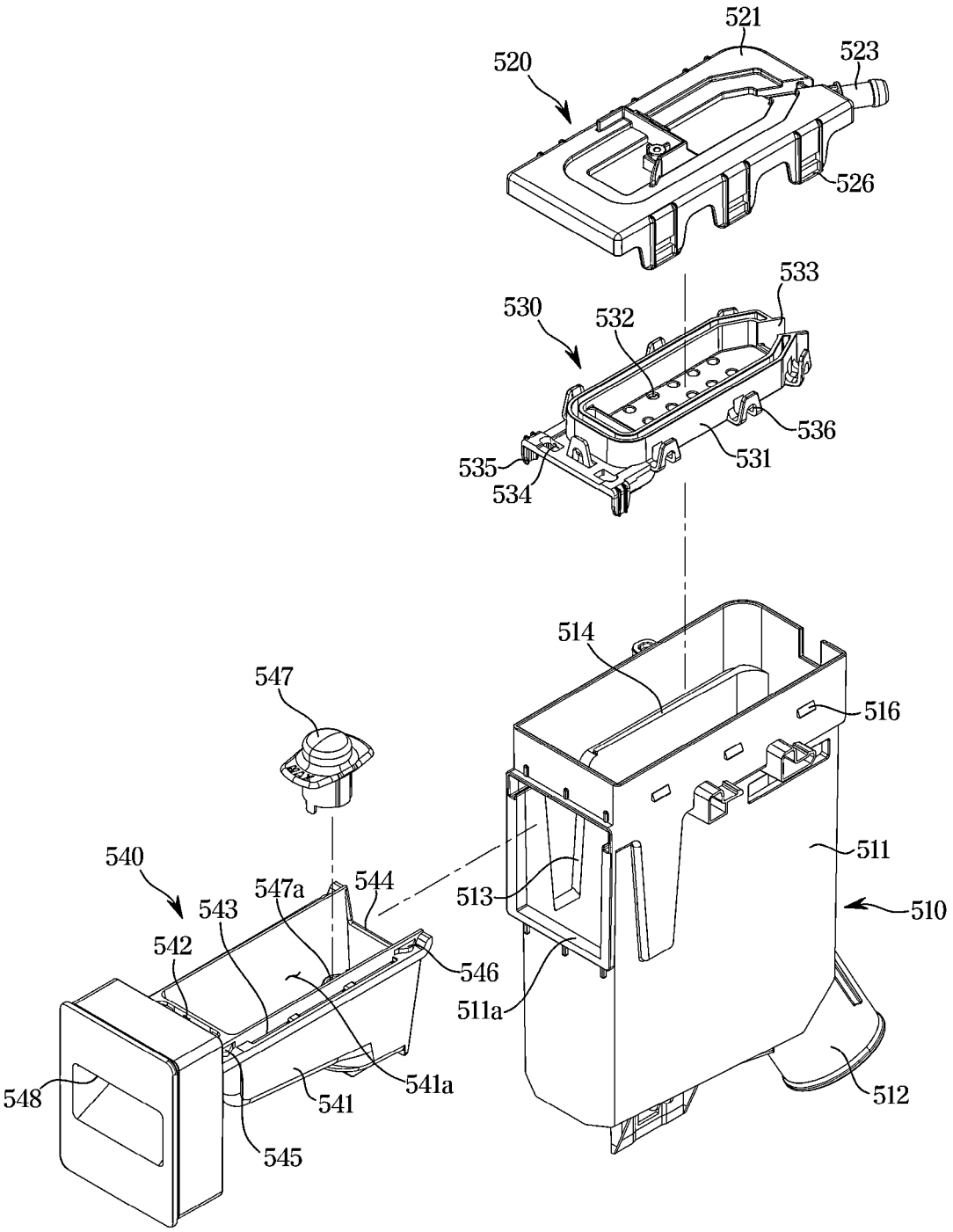
FIG. 8 is an exploded view illustrating a portion of components of a detergent supply device according to an embodiment of the disclosure.
Figure 9:
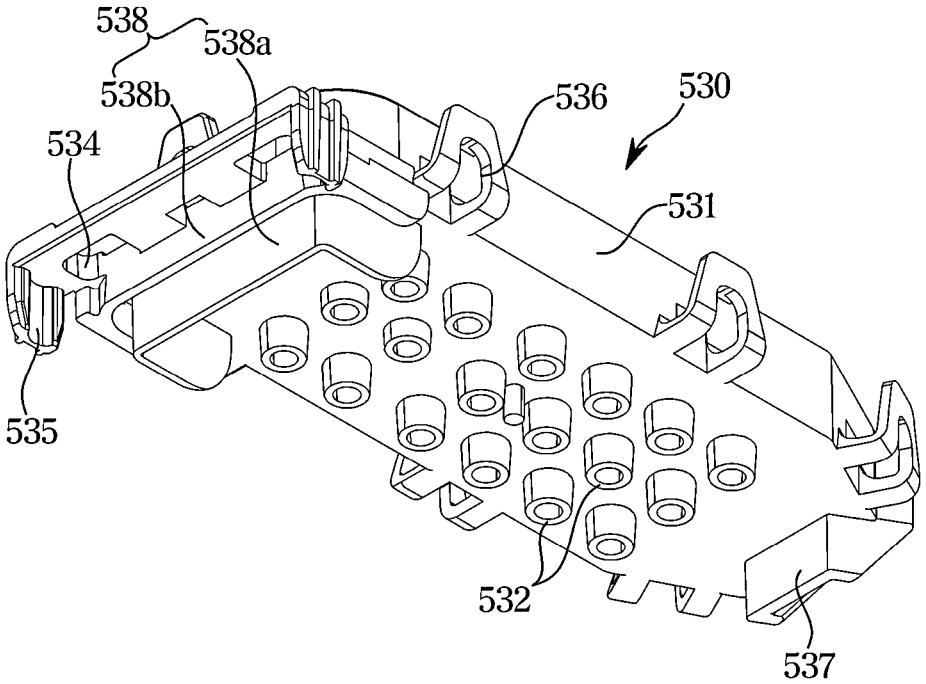
FIG. 9 illustrates a distribution guide of a detergent supply device according to an embodiment of the disclosure.
Figure 10:
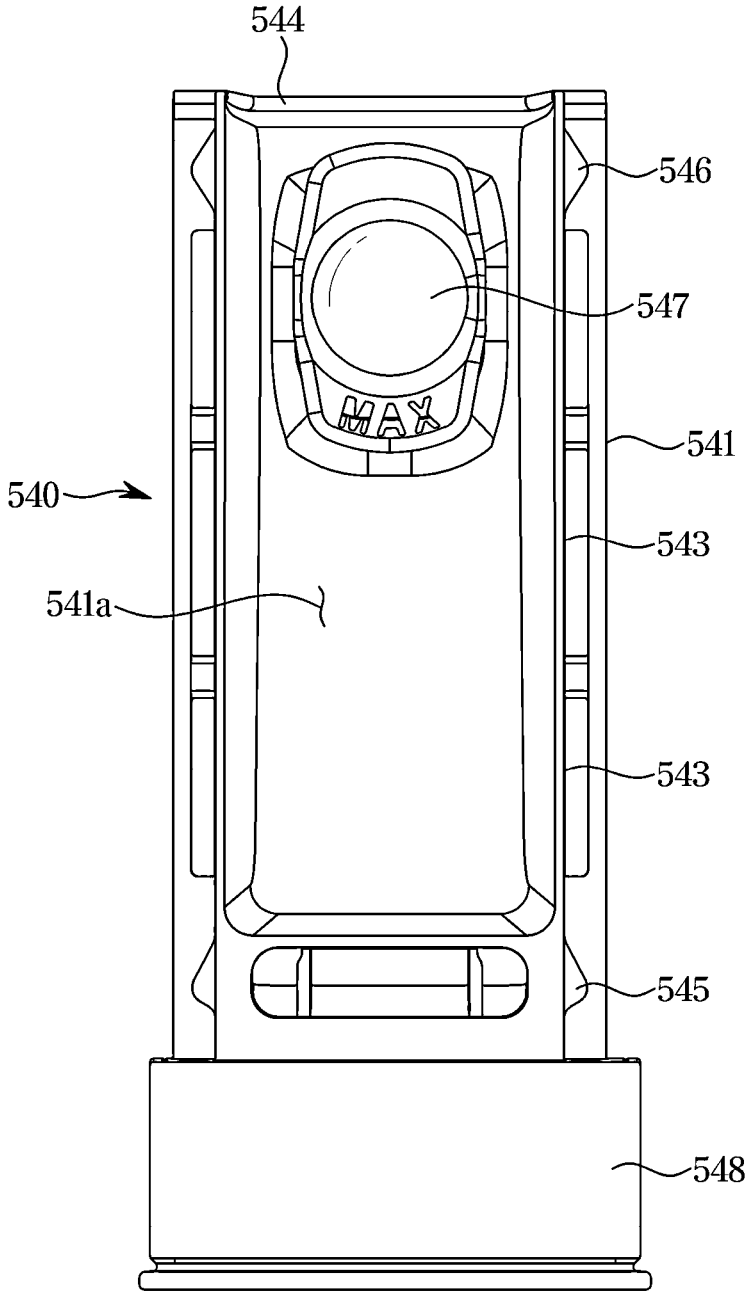
FIG. 10 illustrates a detergent cover of a detergent supply device according to an embodiment of the disclosure.
Figure 11:
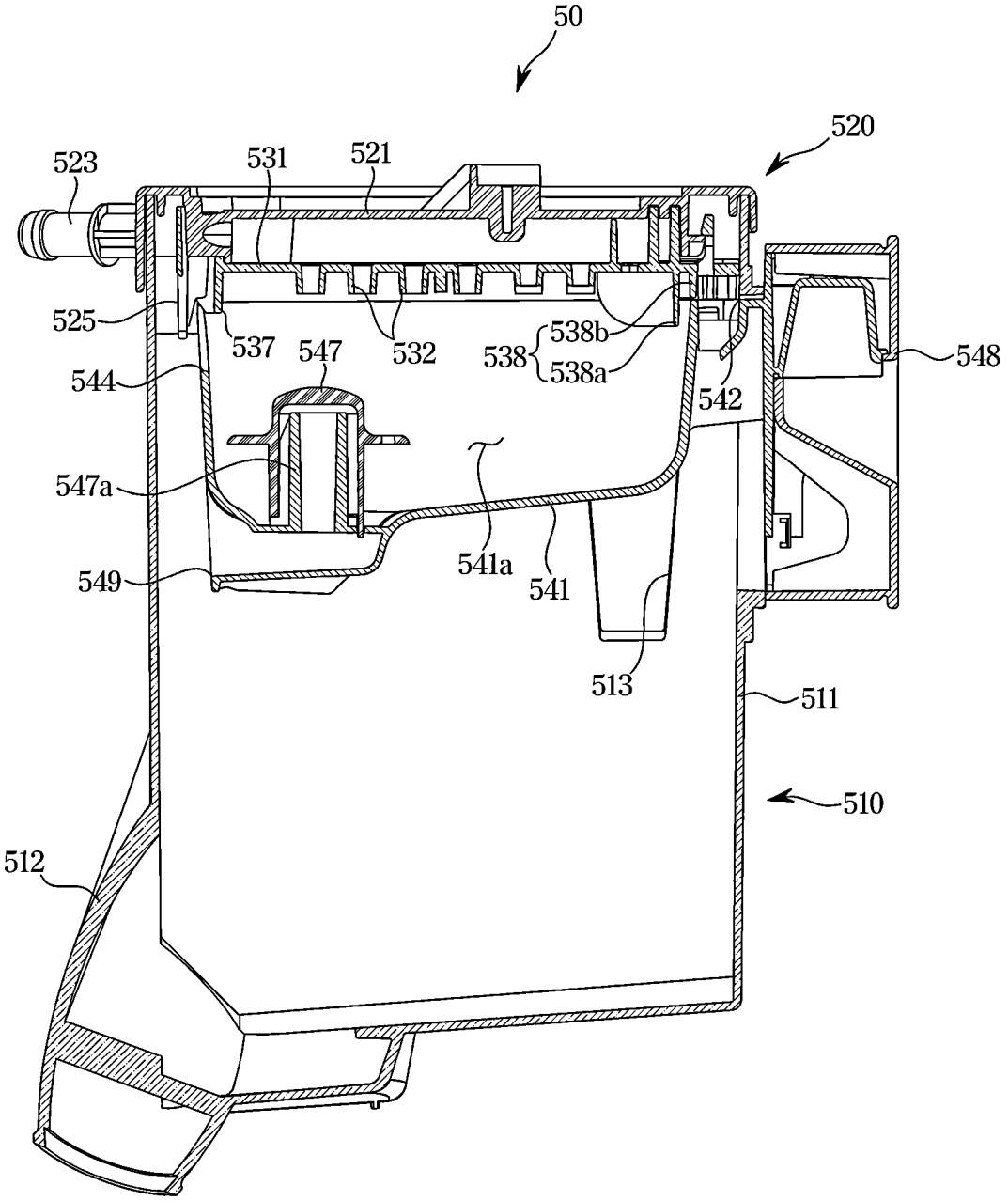
FIG. 11 is a cross-sectional view taken along line A-A' shown in FIG. 7.
Figure 12:
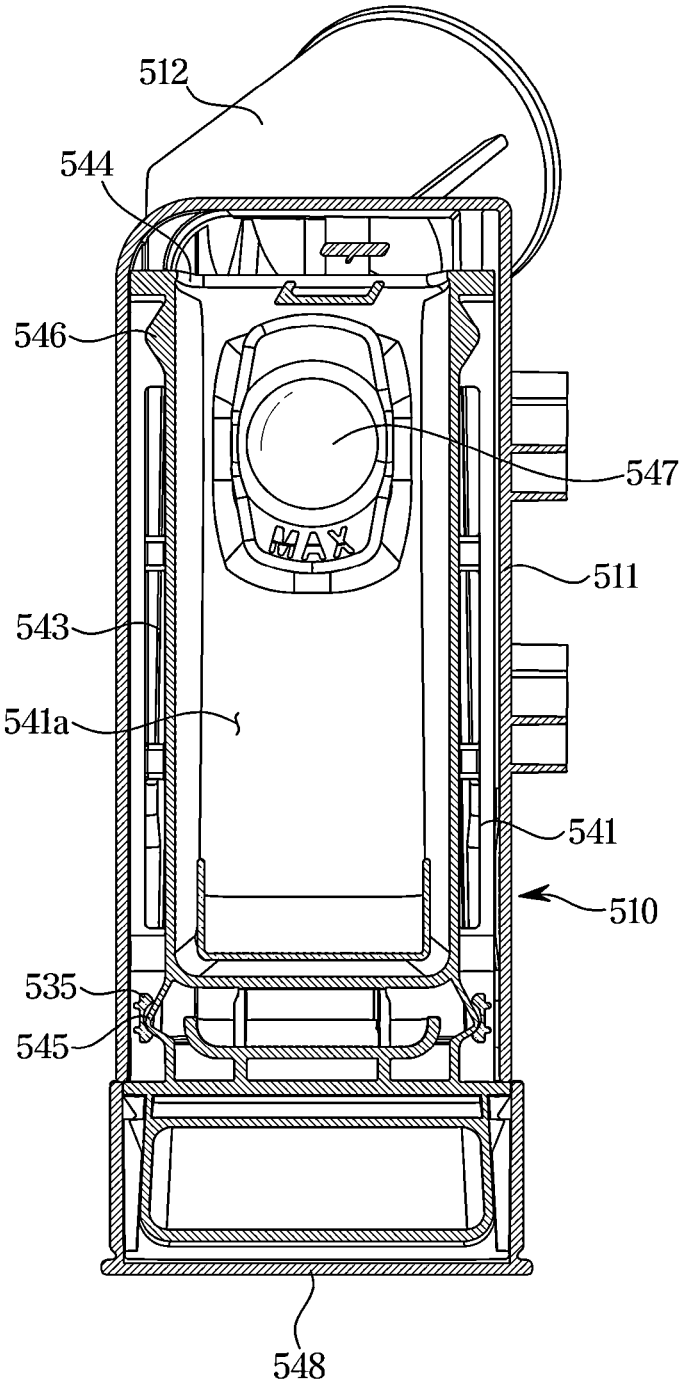
FIG. 12 is a cross-sectional view taken along line B-B' shown in FIG. 7.
Figure 13:
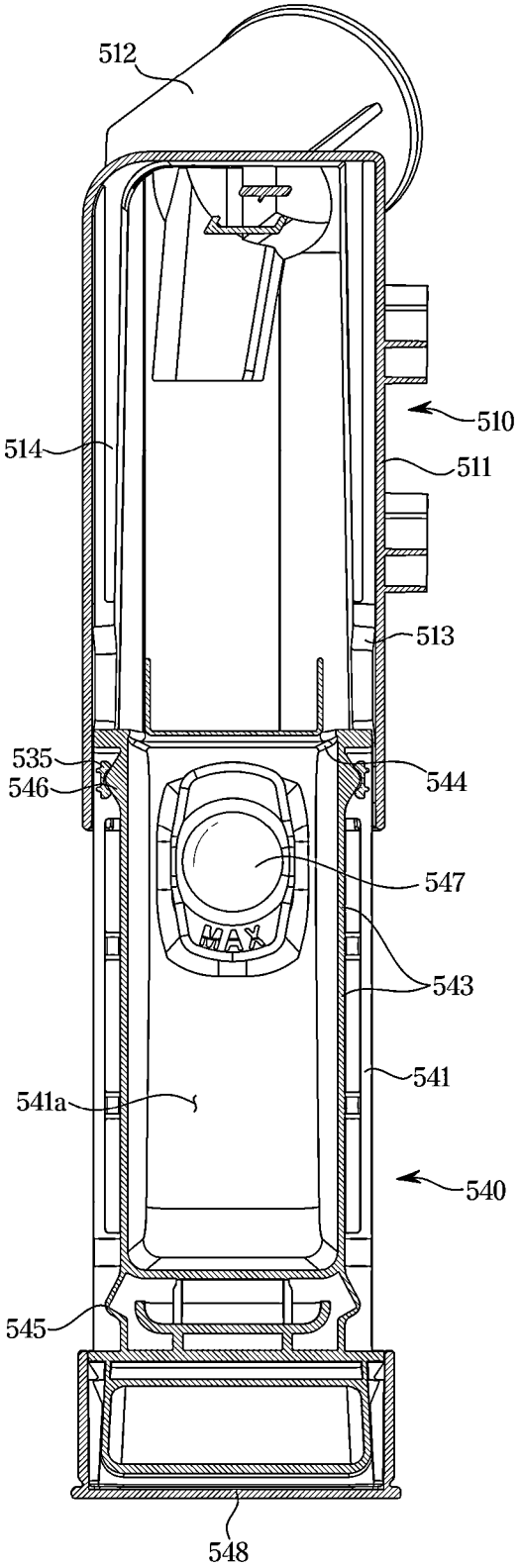
FIG. 13 illustrates a state in which a detergent box is withdrawn from a detergent case shown in FIG. 12.

FIG. 7 illustrates a detergent supply device according to an embodiment of the disclosure. FIG. 8 is an exploded view illustrating a portion of components of a detergent supply device according to an embodiment of the disclosure. FIG. 9 illustrates a distribution guide of a detergent supply device according to an embodiment of the disclosure. FIG. 10 illustrates a detergent cover of a detergent supply device according to an embodiment of the disclosure. FIG. 11 is a cross-sectional view taken along line A-A' shown in FIG. 7. FIG. 12 is a cross-sectional view taken along line B-B' shown in FIG. 7. FIG. 13 illustrates a state in which a detergent box is withdrawn from a detergent case shown in FIG. 12.

Referring to FIG. 7 to FIG. 11, the detergent supply device 50 according to an embodiment of the disclosure may supply water supplied through the water supply valve 42 and the first pipe 441 to the tub 20 along with detergent. For example, the detergent supply device 50 may mix water and additional detergent or bleach, and supply to the tub 20.

The detergent supply device 50 may include a detergent case 510. The detergent case 510 may include a case body 511 for accommodating a detergent box 540. The case body 511 may include a mounting opening 511*a* through which the detergent box 540 is inserted into or withdrawn from the case body 511. At least a portion of the detergent box 540 may be mounted to the detergent case 510 or may be separated from the detergent case 510 by passing through the mounting opening 511*a*.

The detergent case 510 may include a detergent discharge portion 512 for discharging water and detergent mixed in the detergent box 540 into the tub 20. The detergent discharge portion 512 may be located at a lower portion of the case body 511. The detergent discharge portion 512 may be connected to the detergent connection pipe 51. The water and detergent mixed inside the detergent case 510 may be supplied to the tub 20 through the detergent discharge portion 512 and the detergent connection pipe 51.

The detergent case 510 may include a case guide 513 for guiding water and/or detergent overflowing from the detergent box 540 to a lower portion of the case body 511. The case guide 513 may be recessed outwardly from an inner surface of the case body 511. The case guide 513 may include a portion protruding from an outer surface of the case body 511. In a case where the water and/or detergent in a detergent box body 541 overflows through a side drain hole 543 of the detergent box 540, the case guide 513 may guide the water and/or detergent into the detergent case 510.

The detergent case 510 may include a detergent box rail 514 for supporting the detergent box 540 in a state where the detergent box 540 is mounted to the detergent case 510. The detergent box 540 may be guided by the detergent box rail 514 while being mounted to or separated from the detergent case 510. The detergent box rail 514 may support side portions of the detergent box body 541. The detergent box rail 514 may extend along an inner surface of the case body 511.

The detergent case 510 may include a case mounting portion 516 to be coupled to a cover mounting portion 526 of the detergent cover 520. For example, the case mounting portion 516 may protrude from an outer surface of the case body 511, and the cover mounting portion 526 may include a hole or groove that may accommodate the case mounting portion 516, without being limited thereto. The case mounting portion 516 may also include a hole or groove shape, and the cover mounting portion 526 may also include a protrusion.

The detergent supply device 50 may include the detergent cover 520 that may be coupled to the detergent case 510. The detergent case 510 may have a box shape with an open top, and the detergent cover 520 may cover the open top of the detergent case 510. The detergent cover 520 may include the cover body 521 formed to cover the open top of the detergent case 510.

The detergent cover 520 may include the cover mounting portion 526 to be coupled to the case mounting portion 516 of the detergent case 510. The cover mounting portion 526 may extend downward from the cover body 521. When the detergent cover 520 is mounted to the detergent case 510, the case mounting portion 516 may be coupled to the cover mounting portion 526, and thus the detergent cover 520 may be fixed to the detergent case 510.

The detergent cover 520 may include a water supply port 523 to be connected to the first pipe 441. The water supply port 523 may protrude from the cover body 521. Water that has passed through the first pipe 441 may flow into the detergent supply device 50 through the water supply port 523.

Referring to FIG. 11, the detergent cover 520 may include a cover partition 525 for guiding detergent and/or water overflowing from a rear drain hole 544 of the detergent box 540 to the inside of the detergent case 510. The cover partition 525 may prevent the detergent and/or water overflowing from the rear drain hole 544 of the detergent box 540 from leaking to the outside of the detergent supply device 50.

Referring to FIG. 8 and FIG. 9, the detergent supply device 50 may include a distribution guide 530 for distributing the water introduced through the water supply port 523 to the entire detergent box 540. For example, the distribution guide 530 may be mounted to the detergent cover 520, but is not limited thereto, and may be mounted to the detergent case 510.

In a state where the distribution guide 530 is mounted to the detergent cover 520, a flow path may be formed to allow water introduced through the water supply port 523 to flow into the detergent box 540. The distribution guide 530 may be located at an upper portion of the detergent box 540. The distribution guide 530 may include a guide body 531 to form a space for water to flow in a state where the distribution guide 530 is mounted to the detergent cover 520.

The distribution guide 530 may include a guide mounting portion 536 for mounting the distribution guide 530 on the detergent cover 520. As the guide mounting portion 536 is mounted to a portion of the detergent cover 520, the distribution guide 530 may be fixed to the detergent cover 520.

The distribution guide 530 may include a port receiving portion 533 for receiving a portion of the water supply port 523. In a case where the distribution guide 530 and the detergent cover 520 are coupled, the water supply port 523 may be seated in the port receiving portion 533. The port receiving portion 533 may be located at one end of the distribution guide 530. The distribution guide 530 may be arranged to allow at least a portion of the water introduced through the water supply port 523 received in the port receiving portion 533 located at one end of the distribution guide to flow to the other end opposite to the one end.

The distribution guide 530 may include a guide discharge portion 532 for discharging water introduced through the water supply port 523 into the detergent box 540. The guide discharge portion 532 may include a plurality of holes arranged at predetermined intervals in a direction away from the port receiving portion 533. The water flowing in through the water supply port 523 may be uniformly supplied to the detergent box 540 by the guide discharge portion 532.

In order to allow the overflowing water to flow into the detergent case 510 in a case where the water flowing into the distribution guide 530 overflows from a space formed between the distribution guide 530 and the detergent cover 520, the distribution guide 530 may include a guide drain hole 534. Water flowing down through the guide drain hole 534 may flow down into the detergent case 510 through the detergent box drain holes 542, 543, and 544 formed in the detergent box 540.

The distribution guide 530 may include a position fixing portion 535 for fixing a respective position of the detergent box 540 in a case where the detergent box 540 is inserted into the detergent case 510 and in a case where the detergent box 540 is withdrawn from the detergent case 510. The position fixing portion 535 may extend downward from the guide body 531. The position fixing portion 535 may be located at a front end of the guide body 531. For example, the position fixing portion 535 may include a portion having a groove shape.

Referring to FIG. 9 and FIG. 11, the distribution guide 530 may include a guide partition 538 to prevent detergent and/or water from overflowing toward the front drain hole 542 of the detergent box 540. For example, the guide partition 538 may include a first guide partition 538*a* and a second guide partition 538*b*. The first guide partition 538*a* and the second guide partition 538*b* may be spaced apart from each other in a front-to-back direction. The second guide partition 538*b* may be arranged to face a portion of an upper surface of the detergent box body 541. The first guide partition 538*a* and the second guide partition 538*b* may prevent the detergent and/or water in the detergent box body 541 from overflowing from the detergent box 540 by expanding a flow path through which the detergent and/or water in the detergent box body 541 flows to the outside of the detergent box 540.

The distribution guide 530 may include a guide rib 537 for guiding the water and/or detergent overflowing from the detergent box body 541 to overflow through the rear drain hole 544. The guide rib 537 may guide the detergent and/or water to overflow into the detergent case 510 through the rear drain hole 544 of the detergent box 540. The guide rib 537 may prevent water and/or detergent overflowing from the detergent box body 541 from leaking to the outside of the detergent case 510.

Referring to FIG. 8 and FIG. 10, the detergent supply device 50 may include the detergent box 540 for accommodating detergent. The detergent box 540 may be detachably mounted to the detergent case 510. The detergent box 540 may include the detergent box body 541 that forms a space 541*a* for accommodating detergent. In a state where the detergent box body 541 is mounted to the detergent case 510, the detergent box body 541 may be supported by the detergent box rail 514.

The detergent box 540 may include a detergent box handle 548 that is exposed to the outside of the detergent case 510 when the detergent box 540 is mounted to the detergent case 510. The detergent box handle 548 may be located at a front end of the detergent box body 541. The detergent box handle 548 may include a portion having a groove shape to allow a user to hold the handle.

In a case where water and/or detergent overflows from the detergent box 540, the detergent box 540 may include the detergent box drain holes 542, 543, and 544 to guide the overflowing water and/or detergent into the detergent case 510. The detergent box drain holes 542, 543, and 544 may include at least one of the front drain hole 542, the side drain hole 543, or the rear drain hole 544. For example, the detergent box drain holes 542, 543, and 544 may include the front drain hole 542 formed at the front end of the detergent box body 541, the side drain hole 542 formed at a side end of the detergent box body 541, and the rear drain hole 544 formed at the rear end of the detergent box body 541.

The detergent box 540 may include an insertion fixing portion 545 that is arranged to be interfered with by the position fixing portion 535 in order to be fixed in an inserted position in a case where the detergent box 540 is inserted into the detergent case 510. The inserted position may indicate a position where the detergent box 540 is completely mounted to the detergent case 510. The detergent box 540 may include a withdrawal fixing portion 546 that is arranged to be interfered with by the position fixing portion 535 to be fixed in a withdrawn position in a case where the detergent box 540 is withdrawn from the detergent case 510. The withdrawn position may indicate a position where the detergent box 540 is withdrawn from (is pulled out of) the detergent case 510 by a predetermined length to allow a user to put detergent into the detergent box 540. The insertion fixing portion 545 may be located at the front end of the detergent box body 541, and the withdrawal fixing portion 546 may be located at the rear end of the detergent box body 541.

Referring to FIG. 12, in a state where the detergent box 540 is inserted into the detergent case 510, the insertion fixing portion 545 may be coupled to the position fixing portion 535. For example, the position fixing portion 535 may include a portion having a groove shape, and the insertion fixing portion 545 may include a portion having a protruding shape to allow at least a portion to be inserted into the position fixing portion 535, without being limited thereto. The position fixing portion 535 may also have a protrusion shape, and the insertion fixing portion 545 may also include a portion having a groove shape. While the insertion fixing portion 545 is positioned in the position fixing portion 535, the detergent box 540 may be fixed in the position where the detergent box 540 is withdrawn from the detergent case 510.

Referring to FIG. 13, by applying a predetermined or greater force to the detergent box 540, the detergent box 540 may be withdrawn from the detergent case 510. While the detergent box 540 is withdrawn from the detergent case 510, the insertion fixing portion 545 may be separated from the position fixing portion 535.

In a state where the detergent box 540 is withdrawn from the detergent case 510 to the withdrawn position, the withdrawal fixing portion 546 may be coupled to the position fixing portion 535. For example, the position fixing portion 535 may include a portion having a groove shape, and the withdrawal fixing portion 546 may include a portion having a protruding shape to allow at least a portion to be inserted into the position fixing portion 535, without being limited thereto. The position fixing portion 535 may also have a protrusion shape, and the withdrawal fixing portion 546 may also include a portion having a groove shape. While the withdrawal fixing portion 546 is located in the position fixing portion 535, the detergent box 540 may be fixed in the position where the detergent box 540 is withdrawn from the detergent case 510.

The detergent box 540 may include a siphon cap 547 and a siphon tube 547*a* for discharging detergent and water in the detergent box body 541 into the detergent case 510. The detergent and water in the detergent box body 541 may be discharged into the detergent case 510 via a detergent box discharge portion 549 through the siphon cap 547 and the siphon tube 547*a*.

Meanwhile, although not illustrated, the clothes care apparatus 1 according to an embodiment may further include a fourth pipe connectable to a portion different from a portion of the upper detergent supply device 50 to which the first pipe 441 is connected. Unlike the first pipe 441 for supplying water to the inside of the detergent box 540, the fourth pipe may supply water to an outside of the detergent box 540 within the detergent case 510. For example, the fourth pipe may be connected to a portion of a lower portion of the detergent case 510. In the clothes care apparatus 1 according to an embodiment, water supplied through the first pipe 441 may pass through the detergent box 540 and be supplied to the tub 20, and water supplied through the fourth pipe 441 may be supplied to the tub 20 without passing through the detergent box 540. The clothes care apparatus 1 according to an embodiment may control the amount of water supplied through the first pipe 441 and the fourth pipe, thereby preventing water from overflowing in the detergent box 540.

Figure 14:
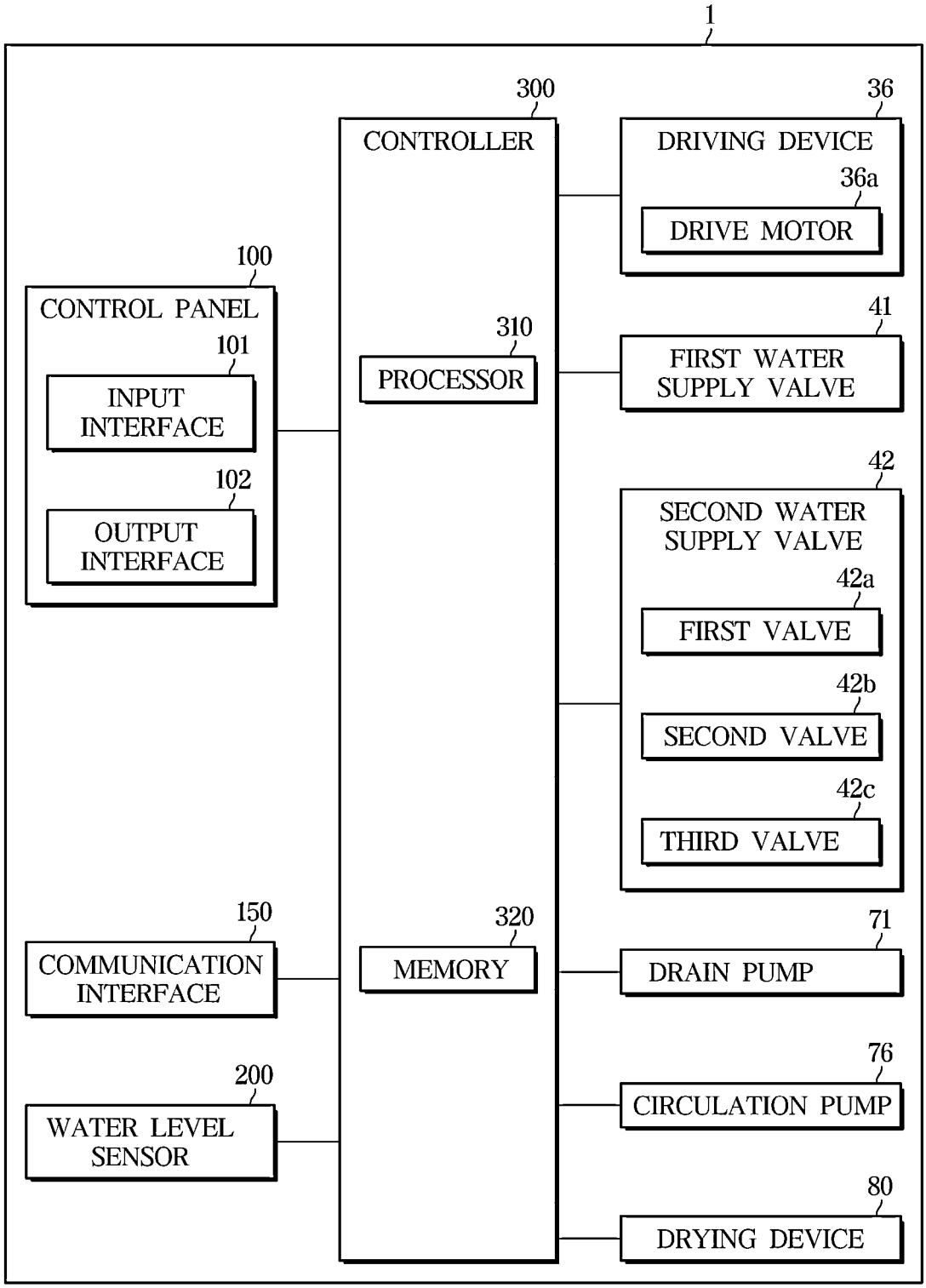
FIG. 14 is a control block diagram of a clothes care apparatus according to an embodiment of the disclosure.

FIG. 14 is a control block diagram of a clothes care apparatus according to an embodiment of the disclosure.

Referring to FIG. 14, the clothes care apparatus 1 may include the controller 300. The controller 300 may be electrically connected to various components and/or devices of the clothes care apparatus 1, and may control the various components and/or devices. For example, the controller 300 may control the driving device 36, the first water supply valve 41, the second water supply valve 42, the drain pump 71, the circulation pump 76, the drying device 80, and the fan 87*a*. In addition, the controller 300 may be electrically connected to the control panel 100, a communication interface 150, and the water level sensor 200. The controller 300 may control the control panel 100, the communication interface 150, and the water level sensor 200.

The controller 300 may include a processor 310 and a memory 320. The memory 320 may include volatile memory (e.g., a static random access memory (S-RAM) and a dynamic random access memory (D-RAM)) and a non-volatile memory (e.g., a read only memory (ROM) and an erasable programmable read only memory (EPROM)). The processor 310 and the memory 320 may be implemented as separate chips or as a single chip. In addition, a plurality of processors and a plurality of memories may be provided. The processor 310 may process various data and signals using instructions, data, programs, and/or software stored in the memory 320. The processor 310 may include a single or a plurality of processing cores. The processor 310 may generate a control signal to control the components of the clothes care apparatus 1.

The control panel 100 may obtain various user inputs and may output various information about an operation of the clothes care apparatus 1. The control panel 100 may include the input interface 101 and the output interface 102.

The controller 300 may control an operation of the clothes care apparatus 1 based on a user input obtained via the control panel 100. For example, the controller 300 may turn the clothes care apparatus 1 on or off based on a user input for turning the clothes care apparatus 1 on or off. The controller 300 may determine an operation course of the clothes care apparatus 1 based on a user input for setting the operation course of the clothes care apparatus 1.

The controller 300 of the clothes care apparatus 1 may determine an operation course of the clothes care apparatus 1 based on a user input obtained through the control panel 100 or a user device. A variety of operation courses of the clothes care apparatus 1 may be provided. For example, the operation course of the clothes care apparatus 1 may be broadly classified into a washing course, a drying course, and a heat exchanger cleaning course.

A variety of washing courses may be provided according to a type of laundry (e.g., clothing, bedclothes, underwear, etc.) and a material of laundry (e.g., cotton, wool, nylon, etc.). For example, the washing course may include at least one of a standard washing course, intense washing course, delicate clothes washing course, bedclothes washing course, baby clothes washing course, towel washing course, boiling washing course, or outdoor clothes washing course. Each of the plurality of washing courses may include different washing settings (e.g., washing temperature, number of times of rinsing, strength of spin-drying, and the like).

In response to a selection of one of the plurality of washing courses through the control panel 100 or an external user device, the controller 300 may control the clothes care apparatus 1 to perform a washing process, a rinsing process, or a spin-drying process corresponding to the selected washing course. In addition, the washing courses may include a rinsing-spin-drying course, a rinsing course, and a spin-drying course. The washing courses are not limited the above examples.

A variety of drying courses may be provided according to a type of an object to be dried (e.g., clothing, bedclothes, underwear, etc.) and a material of an object to be dried (e.g., cotton, wool, nylon, etc.). For example, the drying course may include at least one of a standard drying, intense drying, delicate clothes drying, bedclothes drying, baby clothes drying, towel drying, or outdoor clothes drying. Each of the plurality of drying courses may include different drying settings (e.g., drying temperature, drying time, and the like).

In response to a selection of one of the plurality of drying courses through the control panel 100 or an external user device, the controller 300 may control the clothes care apparatus 1 to perform a drying course corresponding to the selected drying course. The drying courses are not limited the above examples. In order to perform a drying process corresponding to the drying course, the controller 300 may operate the drying device 80. That is, the controller 300 may operate the fan 87*a* and the compressor 91 to dry an object to be dried in the drum 30. In addition, the controller 300 may further operate the drying heater 99 to perform the drying process.

In response to a selection of a washing course corresponding to a type and material of laundry, the controller 300 may automatically select or recommend a drying course corresponding to the selected washing course. In contrast, in response to a selection of a drying course corresponding to a type and material of an object to be dried, the controller 300 may automatically select or recommend a washing course corresponding to the selected drying course. The controller 300 may store (memorize) the washing course and drying course selected by a user, and may provide a washing-drying course that integrates the stored washing course and drying course through the control panel 100 the next time the clothes care apparatus is operated.

Meanwhile, the controller 300 may automatically clean the heat exchangers 92 and 93 included in the drying device 80 before completing the drying process. To clean the heat exchangers, the controller 300 may control the water supply valve 42 to spray water from the nozzle device 96 to the heat exchangers 92 and 93 during a predetermined heat exchanger cleaning time.

The clothes care apparatus 1 according to the disclosure may clean the heat exchangers 92 and 93 each time a drying process is performed, thereby removing contamination (e.g., dust, lint) in the heat exchangers 92 and 93, and keeping the heat exchangers 92 and 93 clean. The heat exchanger cleaning may be performed during a set heat exchanger cleaning time. The drying process may be terminated after the heat exchanger cleaning is completed.

A heat exchanger cleaning course may also be provided to clean the heat exchangers 92 and 93 separately, regardless of whether a drying process is performed. In response to a selection of the heat exchanger cleaning course through the control panel 100 or an external user device, the controller 300 may clean the heat exchangers 92 and 93.

The controller 300 may control the control panel 100 to output various information about an operation of the clothes care apparatus 1. For example, the control panel 100 may visually and/or audibly output information about an operation course, operation time, washing settings, rinsing settings, spin-drying settings, and/or drying settings of the clothes care apparatus 1. In addition, the control panel 100 may output information about an abnormal condition of the clothes care apparatus 1.

The communication interface 150 may include various communication circuits for performing a wired communication and/or wireless communication with an external device (e.g., servers, user devices, and/or other home appliances). A user device may include various electronic devices, such as smartphones, laptops, smart watches, stationary type tablets, and speakers. A user input may be obtained not only through the control panel 100 but also through a user device.

The communication interface 150 may include at least one of a short-range communication circuit or a long-range communication circuit. The communication interface 150 may transmit data to or receive data from an external device. For example, the communication interface 150 may support cellular communication, Wireless Local Area Network (WLAN), Home Radio Frequency (HomeRF), infrared communication, Ultra-Wide Band (UWB) communication, Wi-Fi, Wi-Fi Direct, Bluetooth, and ad-hoc and/or Zigbee. Communication technologies supported by the communication interface 150 are not limited to the above.

The communication interface 150 may communicate with an external device through an Access Point (AP). The AP may connect a Local Area Network (LAN) to which the clothes care apparatus 1 is connected to a Wide Area Network (WAN) to which a server is connected. The clothes care apparatus 1 may be connected to the server through the WAN.

The clothes care apparatus 1 may be connected to other home appliances and/or electronic devices through the communication interface 150. The clothes care apparatus 1 may transmit information related to an operation of the clothes care apparatus 1 (e.g., information related to a washing process and/or a drying process) to the other home appliances and/or electronic devices. A washing course and/or a drying course may be selected not only via the control panel 100, but also via other home appliances and/or electronic devices. In addition, information about the clothes care apparatus 1 may be displayed not only on the control panel 100, but also on the other home appliances and/or electronic devices.

The water level sensor 200 may detect a water level in the tub 20. The water level sensor 200 may transmit an electrical signal corresponding to the water level in the tub 20 to the controller 300. The controller 300 may determine the water level in the tub 20 based on the signal transmitted from the water level sensor 200. The controller 300 may determine the water level in the tub 20 based on a frequency value of the signal transmitted from the water level sensor 200.

The driving device 36 may rotate the drum 30 under the control of the controller 300. The driving device 36 may include the drive motor 36*a*. The controller 300 may control the drive motor 36*a* to adjust a rotation speed of the drum 30.

The water supply device 40 of the clothes care apparatus 1 may include the first water supply valve 41 and the second water supply valve 42. The water supply device 40 may be connected to an external water supply source. The first water supply valve 41 and the second water supply valve 42 may be connected to the external water supply source. As described above, the first water supply valve 41 may correspond to a hot water supply valve, and the second water supply valve 42 may correspond to a cold water supply valve.

The controller 300 may control the water supply device 40. The controller 300 may control an opening and closing of the first water supply valve 41 and the second water supply valve 42, respectively. The controller 300 may adjust an opening degree of each of the first water supply valve 41 and the second water supply valve 42. The first water supply valve 41 may open or close the first water supply pipe 43 based on an electrical signal transmitted from the controller 300.

The second water supply valve 42 may selectively supply water to the upper detergent supply device 50, the nozzle device 96, and the tub 20. As described above, the second water supply pipe 44 may include the first pipe 441, the second pipe 442, and the third pipe 443. The second water supply valve 42 may be connected to the first pipe 441, the second pipe 442, and the third pipe 443. The first pipe 441, the second pipe 442, and the third pipe 443 may be referred to as a first water supply flow path, a second water supply flow path, and a third water supply flow path, respectively. For convenience of description, the second water supply valve 42 may be referred to as a 'water supply valve.'

The controller 300 may control the water supply device 40 to supply water to at least one of the upper detergent supply device 50, the nozzle device 96, or the tub 20 in order to perform at least one of a washing process, a rinsing process, a spin-drying process, or a drying process. The water supply device 40 may open or close at least one of the first water supply flow path, the second water supply flow path, or the third water supply flow path based on an electrical signal transmitted from the controller 300. That is, the controller 300 may control the water supply device 40 to supply water to the upper detergent supply device 50 through the first pipe 441. The controller 300 may control the water supply device 40 to supply water to the nozzle device 96 through the second pipe 442. The controller 300 may control the water supply device 40 to supply water to the tub 20 through the third pipe 443.

The second water supply valve 42 may include the first valve 42*a*, the second valve 42*b*, and the third valve 43*c*. The controller 300 may control an opening and closing of each of the first valve 42*a*, the second valve 42*b*, and the third valve 43*c*. The controller 300 may adjust an opening degree of each of the first valve 42*a*, the second valve 42*b*, and the third valve 43*c*. Once the first valve 42*a* is opened, water may be supplied to the upper detergent supply device 50 through the first pipe 441. Once the second valve 42*b* is opened, water may be supplied to the nozzle device 96 through the second pipe 442. Once the third valve 42*c* is opened, water may be supplied to the tub 20 through the third pipe 443.

The water supply valve 42 may be provided as a single 4-way valve. In a case where the water supply valve 42 is provided as a 4-way valve, a piston assembly in the water supply valve 42 may move under the control of the controller 300. As the piston assembly of the water supply valve 42 moves, water flows through each of the first pipe 441, the second pipe 442, and the third pipe 443, or the flow of water through each of the first pipe 441, the second pipe 442 and the third pipe 443 may be blocked.

The drain pump 71 may discharge water in the tub 20 to the outside of the housing 10. The controller 300 may control the drain pump 71 to discharge water in the tub 20 to the outside through the drain pipe 73.

The circulation pump 76 may allow the water in the tub 20 to flow to the lower detergent supply device 60. The water that has passed through the circulation pump 76 and the lower detergent supply device 60 may return to the tub 20. The controller 300 may control the circulation pump 76 to allow the water in the tub 20 to pass through the lower detergent supply device 60 and circulate.

The drying device 80 may remove moisture from the air, heat the air, and supply the heated air to the tub 20. The controller 300 may operate the drying device 80 to dry the laundry in the drum 30. To generate dry and heated air, the drying device 80 may include the fan 87*a*, the compressor 91, the heat exchangers 92 and 93, and the expansion valve.

The controller 300 may control the fan 87*a*, the compressor 91, and the expansion valve included in the drying device 80. The controller 300 may operate the fan 87*a* to supply dry and heated air into the drum 30. The controller 300 may adjust a rotation speed of the fan 87*a*. A flow rate of air supplied into the drum 30 may vary depending on the rotation speed of the fan 87*a*.

The compressor 91 may discharge high-temperature and high-pressure gaseous refrigerant by compressing low-temperature and low-pressure gaseous refrigerant. For example, the compressor 91 may compress the refrigerant by a reciprocating motion of a piston or a rotating motion of a rotor. The discharged gaseous refrigerant may be delivered to the condenser 92. The controller 300 may adjust an operating frequency and/or Revolution Per Minute (RPM) of the compressor 91. As the operating frequency and/or RPM of the compressor 91 increases, the heat discharged around the condenser 92 may increase. The controller 300 may adjust an opening degree of the expansion valve. The expansion valve may be provided as an electronic expansion valve whose opening may be adjusted by an electric signal and a capillary tube for controlling a pressure of liquid refrigerant. Two-phase refrigerant of low-temperature and low-pressure that has passed through the expansion valve may flow into the evaporator 93.

The controller 300 may control the water supply device 40 to clean the heat exchangers 92 and 93 of the drying device 80. The controller 300 may control the second water supply valve 42 to allow the nozzle device 96 to spray water to the heat exchangers 92 and 93. For example, as the second valve 42*b* constituting the second water supply valve 42 is opened, water may be sprayed from the nozzle device 96 to the heat exchangers 92 and 93.

Figure 15:
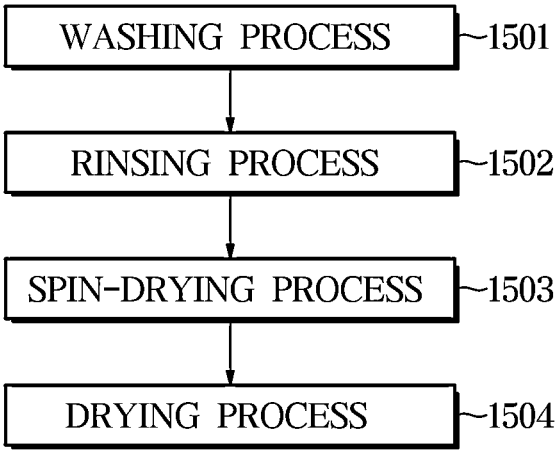
FIG. 15 is a flowchart briefly illustrating entire processes performable by a clothes care apparatus according to an embodiment of the disclosure.

FIG. 15 is a flowchart briefly illustrating entire processes performable by a clothes care apparatus according to an embodiment of the disclosure.

Referring to FIG. 15, the clothes care apparatus 1 may perform at least one of a washing process, a rinsing process, a spin-drying process, or a drying process based on an operation course selected by a user. For example, the operation course of the clothes care apparatus 1 may be determined as a standard washing course and a standard drying course. The standard washing course may include a washing process, a rinsing process, and a spin-drying process. The standard drying course may include a drying process. The clothes care apparatus 1 may sequentially perform a washing process 1501, a rinsing process 1502, a spin-drying process 1503, and a drying process 1504.

The clothes care apparatus 1 may also selectively perform at least one of the washing process 1501, the rinsing process 1502, the spin-drying process 1503, or the drying process 1504 according to an operation course. For example, the clothes care apparatus 1 may perform the rinsing process 1502 and the spin-drying process 1503 in response to a selection of the rinsing-spin-drying course. The clothes care apparatus 1 may perform the spin-drying process 1503 in response to a selection of the spin-drying course. The clothes care apparatus 1 may only perform the drying process 1504 in response to a selection of the standard drying course.

To perform the washing process 1501, the controller 300 of the clothes care apparatus 1 may control the water supply device 40 to supply water to the tub 20. In addition, once at least one of the first water supply valve 41 or the second water supply valve 42 is opened, water may flow into at least one of the upper detergent supply device 50 or the lower detergent supply device 60.

The water supplied to the tub 20 may pass through the lower detergent supply device 60. The detergent introduced into the lower detergent supply device 60 may flow into the tub 20 together with water. In a case where a water level in the tub 20 reaches a predetermined level, the controller 300 may close the first water supply valve 41 and the second water supply valve 42 to stop the supply of water to the tub 20. Thereafter, the controller 300 may rotate the drum 30 to agitate the laundry in the drum 30.

In a case where the detergent for the washing process 1501 is also introduced into the upper detergent supply device 50, the controller 300 may control the water supply device 40 to supply water to the upper detergent supply device 50 as well. Once water is supplied to the upper detergent supply device 50, the detergent introduced into the upper detergent supply device 50 may flow into the tub 20 together with the water.

To deliver the detergent to the tub 20, at least one of the upper detergent supply device 50 or the lower detergent supply device 60 may be used.

Once the washing process 1501 is completed, the rinsing process 1502 may be performed. The rinsing process 1502 may be performed one or more times. To perform the rinsing process 1502, the controller 300 may control the water supply device 40 to supply water to the tub 20.

In a case where the rinsing process 1502 is performed multiple times, in a first rinsing process, a softener introduced into at least one of the upper detergent supply device 50 or the lower detergent supply device 60 may flow into the tub 20 together with water. For example, the controller 300 may control the second water supply valve 42 to move the softener introduced into the upper detergent supply device 50 to the tub 20. Water may be supplied to the upper detergent supply device 50 through the second water supply valve 42 and the first pipe 441.

In a case where a water level in the tub 20 reaches a predetermined level, the controller 300 may control the water supply device 40 to stop the supply of water to the tub 20. That is, the controller 300 may close the first water supply valve 41 and the second water supply valve 42 to stop the supply of water to the tub 20. Thereafter, the controller 300 may rotate the drum 30 to agitate the laundry in the drum 30.

Once the rinsing process 1502 is completed, the spin-drying process 1503 may be performed. To perform the spin-drying process 1503, the controller 300 may operate the drain pump 71 to discharge water in the tub 20 to the outside of the clothes care apparatus 1. In addition, the controller 300 may rotate the drum 30 at a relatively high speed. By rotating the drum 30 rapidly, water may escape from the laundry due to centrifugal force.

Once the spin-drying process 1503 is completed, the drying process 1504 may be performed. To perform the drying process 1504, the controller 300 may operate the drying device 80 to supply hot air into the tub 20 and the drum 30. In addition, the controller 300 may rotate the drum 30 at a relatively low speed.

Immediately after entering the drying process 1504 or before the start of the drying process 1504, water may be supplied to the upper detergent supply device 50 for a predetermined period of time (e.g., 1 second) to prevent leakage of moisture in the tub 20. As described above, the detergent connection pipe 51 connecting the tub 20 and the upper detergent supply device 50 may be U-shaped, and a bent portion of the detergent connection pipe 51 may be filled with water by supplying water to the upper detergent supply device 50. The detergent connection pipe 51 blocked by (filled with) water may prevent the moisture in the tub 20 from being discharged to the outside through the upper detergent supply device 50.

Once the drying process 1504 is completed, the clothes care apparatus 1 may be stopped and be turned off.

FIG. 16 is a table illustrating a method for controlling a clothes care apparatus according to an embodiment of the disclosure.

Referring to a table 1600 of FIG. 16, based on an operation course selected by a user input to the clothes care apparatus 1, whether to perform at least one of a washing process, a rinsing process, a spin-drying process, or a drying process may be determined. To perform at least one of the washing process, the rinsing process, the spin-drying process, or the drying process, the controller 300 may control the water supply device 40 to supply water to at least one of the upper detergent supply device 50, the nozzle device 96, or the tub 20.

A first water supply flow path for supplying water to the upper detergent supply device 50 may refer to the first pipe 441. A second water supply flow path for supplying water to the nozzle device 96 may refer to the second pipe 442. A third water supply flow path for supplying water to the tub 20 may refer to the third pipe 443. As described above, the water supply device 40 may be connected to the first pipe 441, the second pipe 442, and the third pipe 443. The controller 300 may control the water supply device 40 to open or close each of the first pipe 441, the second pipe 442, and the third pipe 443.

For example, the second water supply valve 42 may include the first valve 42*a* for opening or closing the first water supply flow path, the second valve 42*b* for opening or closing the second water supply flow path, and the third valve 43*c* for opening or closing the third water supply flow path.

In another example, the second water supply valve 42 may be provided as a single valve having a flow path switching structure to guide water to at least one of the first water supply flow path, the second water supply flow path, or the third water supply flow path.

To perform the washing process, the controller 300 may control the water supply device 40 to supply water to the tub 20 and block the supply of water to the upper detergent supply device 50 and the nozzle device 96. For example, in the washing process, the controller 300 may close the first valve 42*a* to close the first water supply flow path connected to the upper detergent supply device 50, may close the second valve 42*b* to close the nozzle device 96 connected to the second water supply flow path, and may open the third valve 42*c* to open the third water supply flow path connected to the tub 20.

As the third water supply flow path is opened, water may be supplied to the tub 20. The water supplied to the tub 20 may pass through the lower detergent supply device 60, and the detergent contained in the lower detergent supply device 60 may be automatically introduced into the tub 20. As the detergent is introduced into the tub 20, the washing process may be performed. A user may select automatic detergent dispensing from the control panel 100. In response to a selection of automatic detergent dispensing, the detergent contained in the lower detergent supply device 60 may be automatically dispensed into the tub 20.

To perform the rinsing process, the controller 300 may control the water supply device 40 to supply water to the tub 20 and the upper detergent supply device 50 and block the supply of water to the nozzle device 96. For example, in the rinsing process, the controller 300 may open the first valve 42*a* to open the first water supply flow path connected to the upper detergent supply device 50, may close the second valve 42*b* to close the second water supply flow path connected to the nozzle device 96, and may open the third valve 42*c* to open the third water supply flow path connected to the tub 20.

The control of the opening of the first water supply flow path for supplying water to the upper detergent supply device 50 may be set for the rinsing process as a default. In addition, the opening of the first water supply flow path may be controlled according to user's settings.

For example, a user may select a manual setting for manually adding softener and/or bleach on the control panel 100. The user may add the softener and/or bleach to the upper detergent supply device 50. The controller 300 may operate the first valve 42*a* to move the water supplied to the upper detergent supply device 50 together with the softener and/or bleach added to the upper detergent supply device 50 to the tub 20 during the rinsing process.

In a case where a user selects an automatic setting for automatically adding softener and/or bleach on the control panel 100, the controller 300 may close the first valve 42*a* to close the first water supply flow path connected to the upper detergent supply device 50.

In the spin-drying process, water may be supplied to the tub 20 for a predetermined period of time to clean the door 17. In order to clean the door 17 based on the start of the spin-drying process, the controller 300 may control the water supply device 40 to supply water to the tub 20 and block the supply of water to the upper detergent supply device 50 and the nozzle device 96 for a predetermined door cleaning time (e.g., 3 seconds). For example, in order to clean the door 17 in the spin-drying process, the controller 300 may close the first valve 42*a* to close the first water supply flow path connected to the upper detergent supply device 50, may close the second valve 42*a* to close the second water supply flow path connected to the nozzle device 96, and may open the third valve 42*c* to open the third water supply flow path connected to the tub 20.

The water sprayed toward a front upper side of the tub 20 through the third pipe 443 may clean the door 17 located in front of the tub 20. The door cleaning may be performed early in the spin-drying process. After the door cleaning time has elapsed, all the water supply flow paths may be closed. The water supplied to the tub 20 for cleaning the door 17 may be discharged to the outside of the clothes care apparatus 1 as the spin-drying process proceeds.

In the drying process, water may be supplied to the upper detergent supply device 50 for a predetermined period of time to prevent moisture in the tub 20 from leaking to the outside. Based on entering the drying process, the controller 300 may control the water supply device 40 to supply water to the upper detergent supply device 50 and block the supply of water to the tub 20 and the nozzle device 96 for a predetermined period of time (e.g., 1 second) in order to prevent moisture leakage from the tub 20. For example, in the early drying process, the controller 300 may open the first valve 42*a* to open the first water supply flow path connected to the upper detergent supply device 50. Once water is supplied to the upper detergent supply device 50, a bent portion of the detergent connection pipe 51 connecting the tub 20 and the upper detergent supply device 50 may be blocked by (filled with) water, and the moisture in the tub 20 may be prevented from leaking to the outside through the upper detergent supply device 50.

While the drying device 80 is operating in the drying process, the controller 300 may close all of the water supply flow paths. In other words, while hot air is supplied to the tub 20 and the drum 30, water may not be supplied to the upper detergent supply device 50, the nozzle device 96, and the tub 20.

The clothes care apparatus 1 may clean the heat exchangers 92 and 93 included in the drying device 80 before completing the drying process. Water may be supplied to the nozzle device 96 for a predetermined period of time to clean the heat exchangers. The controller 300 may control the water supply device 40 to supply water to the nozzle device 96 for a predetermined heat exchanger cleaning time (e.g., 1 second) before completing the drying process and block the supply of water to the tub 20 and the upper detergent supply device 50. For example, the controller 300 may close the first valve 42*a* to close the first water supply flow path connected to the upper detergent supply device 50, may open the second valve 42*b* to open the second water supply flow path connected to the nozzle device 96, and may close the third valve 42*c* to close the third water supply flow path connected to the tub 20. By cleaning the heat exchangers 92 and 93, contamination (e.g. dust, lint) of the heat exchangers 92 and 93 may be removed, and the heat exchangers 92 and 93 may be kept clean.

According to an embodiment, a clothes care apparatus 1 may include: a tub; an upper detergent supply device disposed above the tub; a lower detergent supply device disposed below the tub; a heat exchanger disposed above the tub; a nozzle device configured to spray water to the heat exchanger; a first pipe configured to supply water to the upper detergent supply device; a second pipe configured to supply water to the nozzle device; a third pipe configured to supply water to the tub; a water supply device configured to be connected to the first pipe, the second pipe, and the third pipe; and a controller configured to control the water supply device to supply water to at least one of the upper detergent supply device, the nozzle device or the tub, so as to perform at least one of a washing process, a rinsing process, a spin-drying process or a drying process.

The controller may be configured to control the water supply device to supply water to the tub and block supply of water to the upper detergent supply device and the nozzle device, so as to perform the washing process.

The controller may be configured to control the water supply device to supply water to the upper detergent supply device and the tub and block supply of water to the nozzle device, so as to perform the rinsing process.

The clothes care apparatus 1 may further include a door configured to open or close a laundry inlet formed on one side of the tub. The controller may be configured to control the water supply device to supply water to the tub and block supply of water to the upper detergent supply device and the nozzle device for a predetermined door cleaning time, so as to clean the door based on a start of the spin-drying process.

The controller may be configured to, based on entering the drying process, control the water supply device to supply water to the upper detergent supply device and block supply of water to the tub and the nozzle device for a predetermined period of time, so as to prevent moisture in the tub from leaking out.

The clothes care apparatus 1 may further include a connection pipe provided in a form of a U-shape and configured to connect the upper detergent supply device and the tub.

The controller may be configured to control the water supply device to supply water to the nozzle device and block supply of water to the tub and the upper detergent supply device for a predetermined heat exchanger cleaning time before completion of the drying process.

The water supply device may include: a first valve configured to be connected to the first pipe; a second valve configured to be connected to the second pipe; and a third valve configured to be connected to the third pipe. The controller may be configured to control the first valve, the second valve, and the third valve to supply water to at least one of the nozzle device or the tub.

The controller may be configured to determine whether to perform at least one of the washing process, the rinsing process, the spin-drying process, or the drying process, based on an operation course selected by a user input.

According to an embodiment, a method for controlling a clothes care apparatus 1 may include: determining an operation curse of the clothes care apparatus based on a user input; determining to perform at least one of a washing process, a rinsing process, a spin-drying process, or a drying process, based on the operation course; controlling a water supply device to supply water to at least one of a tub, an upper detergent supply device disposed above the tub, or a nozzle device configured to spray water to a heat exchanger, so as to perform at least one of the washing process, the rinsing process, the spin-drying process, or the drying process.

The water supply device may be configured to be controlled to supply water to the tub and block supply of water to the upper detergent supply device and the nozzle device, so as to perform the washing process.

The water supply device may be configured to be controlled to supply water to the tub and the upper detergent supply device and block supply of water to the nozzle device, so as to perform the rinsing process.

The water supply device may be configured to be controlled to supply water to the tub and block supply of water to the nozzle device and the upper detergent supply device for a predetermined door cleaning time, so as to clean a door based on a start of the spin-drying process.

The water supply device may be configured to, based on entering the drying process, be controlled to supply water to the upper detergent supply device and block supply of water to the tub and the nozzle device for a predetermined period of time, so as to prevent moisture in the tub from leaking out.

The water supply device may be configured to be controlled to supply water to the nozzle device and block supply of water to the tub and the upper detergent supply device for a predetermined heat exchanger cleaning time before completion of the drying process.

The water supply device may include: a first valve configured to supply water to the upper detergent supply device; a second valve configured to supply water to the nozzle device; and a third valve configured to supply water to the tub. The controlling of the water supply device may include controlling the first valve, the second valve, and the third valve to supply water to at least one of the nozzle device or the tub.

As is apparent from the above, the clothes care apparatus may prevent leakage through a detergent supply device.

The clothes care apparatus and the method for controlling the same may selectively supply water to at least one of a detergent supply device, a nozzle device, or a tub according to a washing process, a rinsing process, a spin-drying process or a drying process.

The clothes care apparatus and the method for controlling the same may prevent moisture leakage through a detergent supply device during a drying process.

The disclosed embodiments may be implemented in the form of a recording medium that stores instructions executable by a computer. The instructions may be stored in the form of program codes, and when executed by a processor, the instructions may create a program module to perform operations of the disclosed embodiments.

The machine-readable storage medium may be provided in the form of a non-transitory storage medium. Here, when a storage medium is referred to as "non-transitory", it may be understood that the storage medium is tangible and does not include a signal (e.g., an electromagnetic wave), but rather that data is semi-permanently or temporarily stored in the storage medium. For example, a "non-transitory storage medium" may include a buffer in which data is temporarily stored.

According to an embodiment, the method according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed (e.g., download or upload) through an application store (e.g., Play Store™) online or directly between two user devices (e.g., smartphones). In the case of online distribution, at least a portion of the computer program product (e.g., downloadable app) may be stored at least semi-permanently or may be temporarily generated in a storage medium, such as a memory of a server of a manufacturer, a server of an application store, or a relay server.

Although disclosure has been shown and described in relation to specific embodiments, it would be appreciated by those skilled in the art that changes and modifications may be made in these embodiments without departing from the principles and scope of the disclosure, the scope of which is defined in the claims and their equivalents.

The invention claimed is:

1. A clothes care apparatus, comprising:

a tub;

an upper detergent supply device above the tub;

a heat exchanger above the tub;

a nozzle device configured to spray water to the heat exchanger to clean the heat exchanger;

a water supply device fluidly connected to an external water supply source including:

a first pipe configured to guide water supplied from the external water supply source to the upper detergent supply device, a second pipe configured to guide water supplied from the external water supply source to the nozzle device, and a third pipe configured to guide water supplied from the external water supply source to the tub, and a controller configured to control the water supply device to supply water to at least one of the first pipe to be guided to the upper detergent supply device, the second pipe to be guided to the nozzle device, or the third pipe to be guided to the tub, so as to perform at least one of a washing process, a rinsing process, a spin-drying process, or a drying process.

2. The clothes care apparatus of claim 1, wherein the controller is further configured to control the water supply device to:

so as to perform of the washing process, supply water to the third pipe to be guided to the tub, block water from being supplied to the first pipe so as to prevent water from being guided to the upper detergent supply device, and block water from being supplied to the second pipe so as to prevent water from being guided to the nozzle device.

3. The clothes care apparatus of claim 1, wherein the controller is further configured to control the water supply device to:

so as to perform the rinsing process, supply water to the first pipe to be guided to the upper detergent supply device, to supply water to the third pipe to be guided to the tub, and to block water from being supplied to the second pipe so as to prevent water from being guided to the nozzle device.

4. The clothes care apparatus of claim 1, further comprising:

a door configured to open and close a laundry inlet on a side of the tub, wherein the third pipe is further configured to guide water supplied by the water supply device to the door for cleaning the door, and the controller is further configured to control the water supply device to:

so as to clean the door based on a start of the spin-drying process, supply water to the third pipe to be guided to the door for cleaning the door, block water from being supplied to the first pipe so as to prevent water from being guided to the upper detergent supply device, and to block water from being supplied to the second pipe so as to prevent water from being guided to the nozzle device for a door cleaning time.

5. The clothes care apparatus of claim 1, wherein the controller is further configured to;

so as to prevent moisture in the tub from leaking out of the tub based on entering the drying process, control the water supply device to:

supply water to the first pipe to be guided to the upper detergent supply device, block water from being supplied to the third pipe so as to prevent water from being guided to the tub, and block water from being supplied to the second pipe so as to prevent water from being guided to the nozzle device for a period of time.

6. The clothes care apparatus of claim 5, further comprising a connection pipe having a U-shape and configured to connect the upper detergent supply device and the tub.

7. The clothes care apparatus of claim 1, wherein the controller is further configured to control the water supply device to:

so as to prevent water from being supplied to the upper detergent supply device for a heat exchanger cleaning time before completion of the drying process, supply water to the second pipe to be guided to the nozzle device, to block water from being supplied to the third pipe so as to prevent water from being guided to tub, and block water from being supplied to the first pipe.

8. The clothes care apparatus of claim 1, wherein the water supply device further includes:

a first valve connected to the first; pipe, a second valve connected to the second pipe, and a third valve connected to the third pipe, and the controller is further configured to control the first valve, the second valve, and the third valve to supply water to at least one of the first pipe to be guided to the upper detergent supply device, the second pipe to be guided to the nozzle device, or the third pipe to be guided to the tub.

9. The clothes care apparatus of claim 1, wherein the controller is further configured to determine whether to perform at least one of the washing process, the rinsing process, the spin-drying process, or the drying process, based on an operation course selected by a user.

10. A method for controlling a clothes care apparatus having a tub, an upper detergent supply device above the tub, a heat exchanger above the tub, a nozzle device configured to spray water to the heat exchanger to clean the heat exchanger, a water supply device connected to an external water supply source including a first pipe configured to guide water supplied from the external water supply source to the upper detergent supply device, a second pipe configured to guide water supplied from the external water supply source to the nozzle device, and a third pipe configured to guide water supplied from the external water supply source to the tub, and a controller, the method comprising:

by the controller, determining an operation course of the clothes care apparatus based on a user input;

determining to perform at least one of a washing process, a rinsing process, a spin-drying process, or a drying process, based on the determined operation course;

controlling the water supply device to supply water to at least one of the first pipe to be guided to the upper detergent supply device, the second pipe to be guided to the nozzle device, or the third pipe to be guided to the tub, so as to perform the at least one of the washing process, the rinsing process, the spin-drying process, or the drying process that was determined to be performed.

11. The method of claim 10, wherein the controlling the water supply device further includes controlling the water supply device to:

so as to perform the washing process, supply water to the third pipe to be guided to the tub, block water from being supplied to the first pipe so as to prevent water from being guided to the upper detergent supply device, and block water from being supplied to the second pipe so as to prevent water from being guided to the nozzle device.

12. The method of claim 10, wherein the controlling the water supply device further includes controlling the water supply device to:

so as to perform the rinsing process, supply water to the third pipe to be guided to the tub, supply water to the first pipe to be guided to the upper detergent supply device, and block water from being supplied to the second pipe so as to prevent water from being guided to the nozzle device.

13. The method of claim 10, wherein the clothes care apparatus further includes a door configured to open and close a laundry inlet on a side of the tub and the third pipe is further configured to guide water supplied by the water supply device to the door for cleaning the door, and the controlling the water supply device further includes controlling the water supply device to:

so as to clean the door based on a start of the spin-drying process, supply water to the third pipe to be guided to the door for cleaning the door, block water from being supplied to the second pipe so as to prevent water from being guided to the nozzle device, and block water from being supplied to the first pipe so as to prevent water from being guided to the upper detergent supply device for a door cleaning time.

14. The method of claim 10, wherein the controlling the water supply device further includes;

so as to prevent moisture in the tub from leaking out of the tub based on entering the drying process, controlling the water supply device to:

supply water to the first pipe to be guided to the upper detergent supply device, block water from being supplied to the third pipe so as to prevent water from being guided to the tub, and to block water from being supplied to the second pipe so as to prevent water from being guided to the nozzle device for a period of time.

15. The method of claim 10, wherein the controlling the water supply device further includes controlling the water supply device to:

so as to prevent water from being guided to the upper detergent supply device for a heat exchanger cleaning time before completion of the drying process, supply water to the second pipe to be guided to the nozzle device, block water from being supplied to the third pipe so as to prevent water from being guided to the tub, and block water from being supplied to the first pipe.

* * * * *